US011053722B2

(12) United States Patent
Teta et al.

(10) Patent No.: US 11,053,722 B2
(45) Date of Patent: Jul. 6, 2021

(54) SELECTIVELY CLOSABLE HINGE

(71) Applicant: Jeffrey Michael Teta, Hampstead, NC (US)

(72) Inventors: Jeffrey Michael Teta, Hampstead, NC (US); Keith Andrew Palumbo, East Northport, NY (US); Joshua Vaughn Dittrich, Somerville, MA (US); Tyler Theodore McCormack, Jamaica Plain, MA (US); Alexander Racine Martinez, Woburn, MA (US)

(73) Assignee: Jeffrey Michael Teta, Hampstead, NC (US)

( * ) Notice: Subject to any disclaimer, the term of this patent is extended or adjusted under 35 U.S.C. 154(b) by 65 days.

(21) Appl. No.: 16/132,415

(22) Filed: Sep. 15, 2018

(65) Prior Publication Data

US 2019/0085606 A1 Mar. 21, 2019

Related U.S. Application Data

(60) Provisional application No. 62/620,976, filed on Jan. 23, 2018, provisional application No. 62/559,382, filed on Sep. 15, 2017.

(51) Int. Cl.

| | |
|---|---|
| ***A62C 2/24*** | (2006.01) |
| ***E05F 1/00*** | (2006.01) |
| ***E05F 1/12*** | (2006.01) |
| ***E05D 11/10*** | (2006.01) |
| ***E05D 3/02*** | (2006.01) |
| *A62C 2/06* | (2006.01) |

(52) U.S. Cl.

CPC ..... *E05F 1/1207* (2013.01); *E05D 3/02* (2013.01); *E05D 11/10* (2013.01); *A62C 2/241* (2013.01); *A62C 3/14* (2013.01); *E05F 1/006* (2013.01); *E05Y 2800/414* (2013.01); *E05Y 2800/416* (2013.01)

(58) Field of Classification Search

CPC ..... E05F 1/006; A62C 3/14; A62C 2/241
USPC ..... 16/222, 54
See application file for complete search history.

(56) References Cited

U.S. PATENT DOCUMENTS

| | | | | | |
|---|---|---|---|---|---|
| 2,520,536 | A * | 8/1950 | Feeley | A62C 2/242 | 16/222 |
| 4,102,013 | A * | 7/1978 | Newlon | E05D 5/128 | 16/222 |
| 4,141,123 | A * | 2/1979 | Newlon | E05D 5/128 | 29/11 |
| 4,339,845 | A * | 7/1982 | Newlon | E05F 1/1215 | 16/300 |
| 4,583,262 | A * | 4/1986 | Werner | E05F 1/1215 | 16/300 |
| 4,726,613 | A * | 2/1988 | Foshee | E05B 65/104 | 292/150 |

(Continued)

*Primary Examiner* — Jeffrey O'Brien
(74) *Attorney, Agent, or Firm* — Collard & Roe, P.C.

(57) ABSTRACT

There is a temperature activated spring hinge comprising hinge section comprising at least one door leaf and at least one hinge leaf. There is also a fuse which is configured to react in response to an elevated temperature. The fuse can be positioned inside one of the knuckles of the door leaf. There is also a biasing element configured to bias the hinge in a closed position. In at least one embodiment the biasing element is a spring. There is also at least one guide configured to guide a movement of the hinge when the hinge moves from an open position to a closed position.

8 Claims, 23 Drawing Sheets

(56) References Cited

U.S. PATENT DOCUMENTS

| | | | | | |
|---|---|---|---|---|---|
| 5,058,236 | A * | 10/1991 | Henson | E05D 7/0027 | 16/222 |
| 5,121,950 | A * | 6/1992 | Davidian | E05B 65/104 | 292/164 |
| 5,864,920 | A * | 2/1999 | Lasson | A62C 2/241 | 16/48.5 |
| 8,375,519 | B1 * | 2/2013 | Cooper | E05F 1/006 | 16/319 |
| 8,955,194 | B2 * | 2/2015 | Teta | E05F 1/1207 | 16/222 |
| 10,626,651 | B2 * | 4/2020 | Chang | E05F 3/20 | |
| 2019/0330903 | A1 * | 10/2019 | Talpe | E05F 1/1207 | |
| 2020/0173213 | A1 * | 6/2020 | Bucklin | E05F 1/1207 | |

* cited by examiner

FIG. 6A
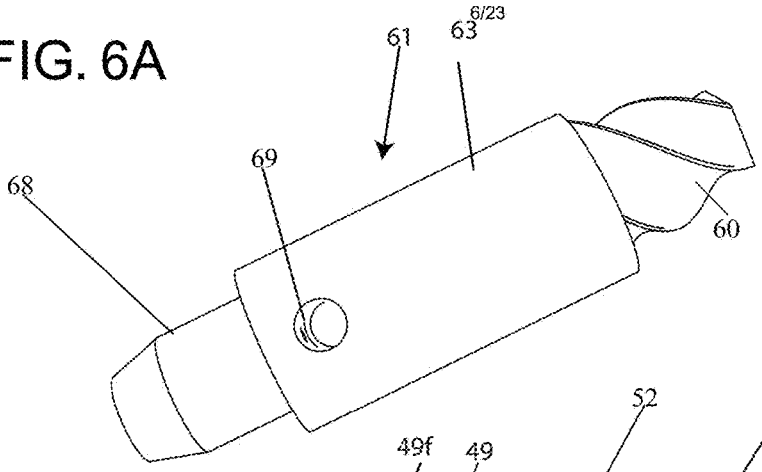
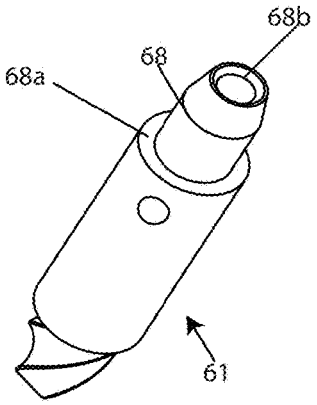
FIG. 6B
FIG. 6C
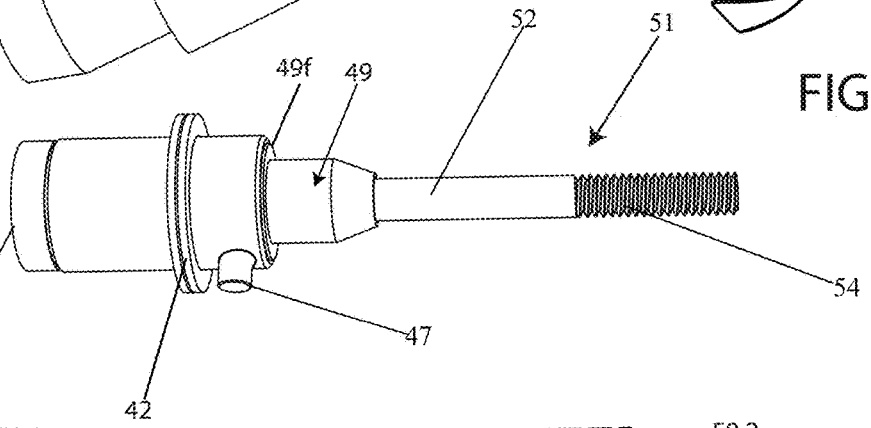
FIG. 6D
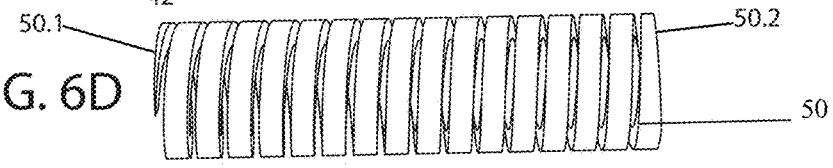
FIG. 6E
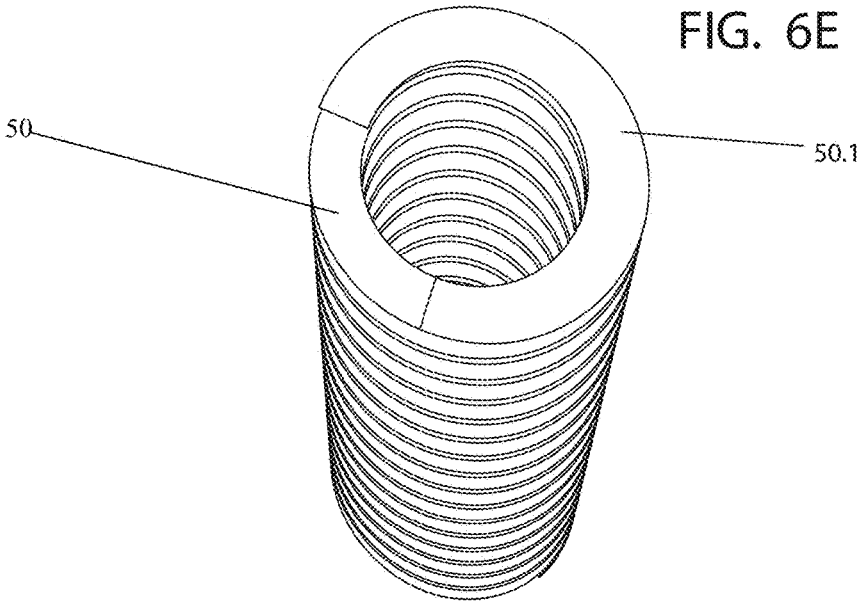

FIG. 9A
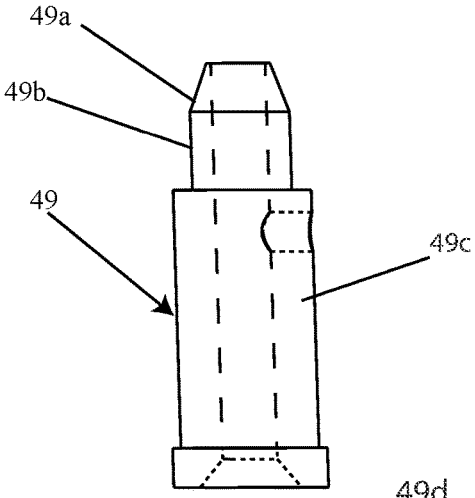
FIG. 9B
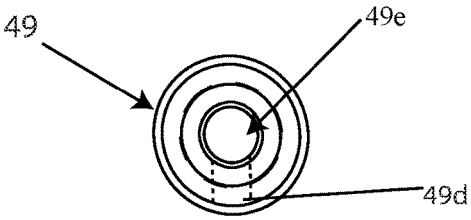
FIG. 9C
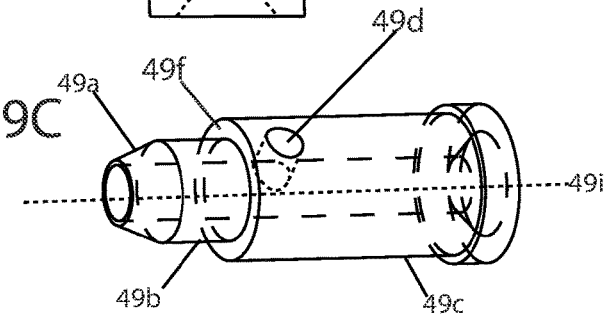
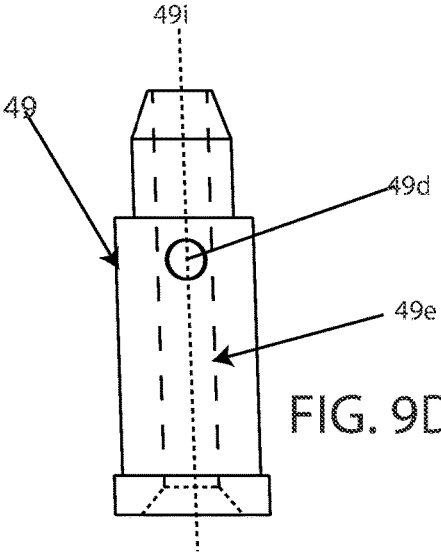
FIG. 9D
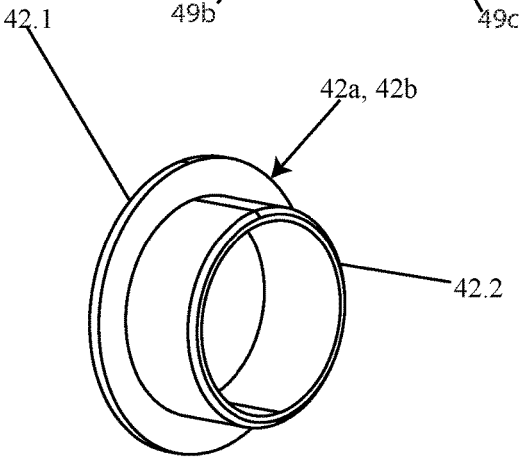
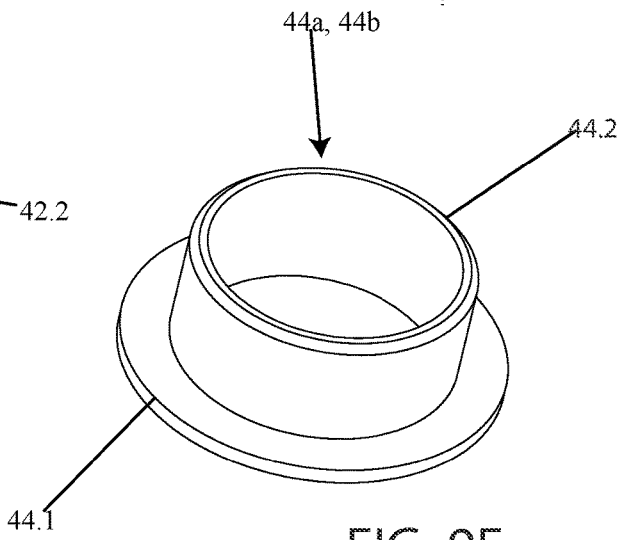
FIG. 9E
FIG. 9F

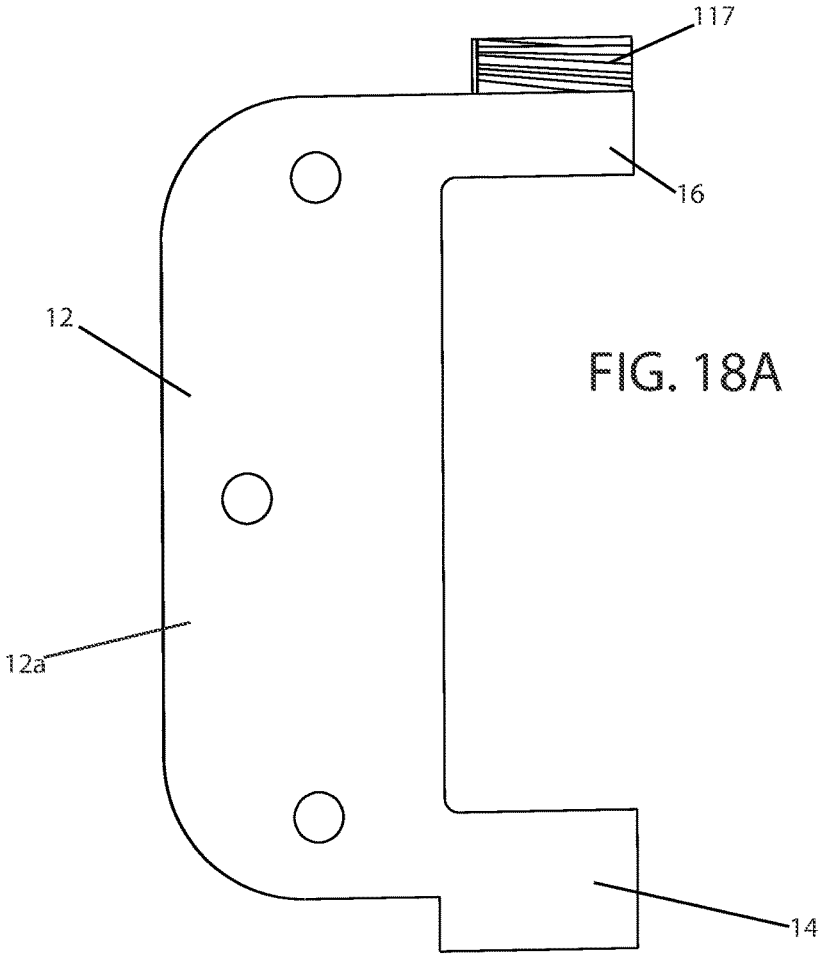
FIG. 18A
FIG. 18B
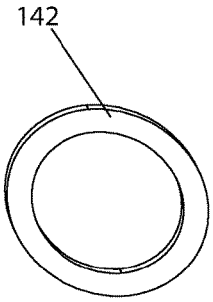
FIG. 18C
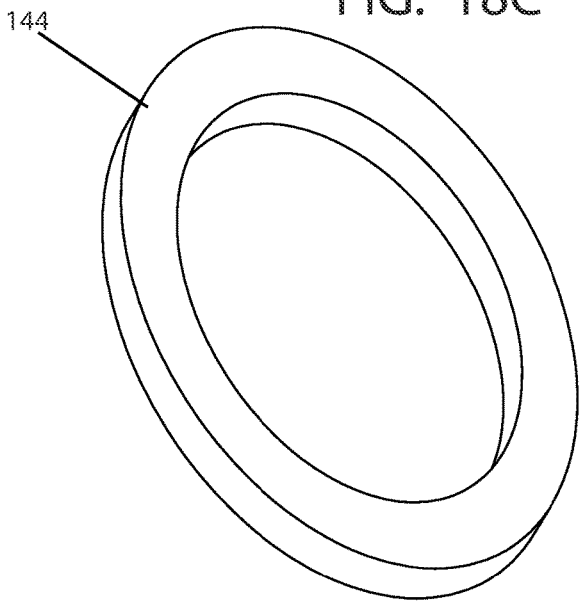
FIG. 18D
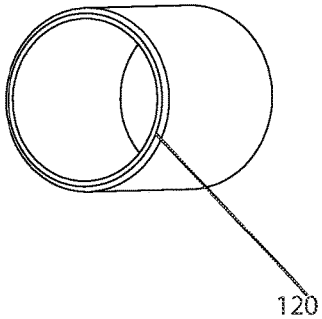

FIG. 22A
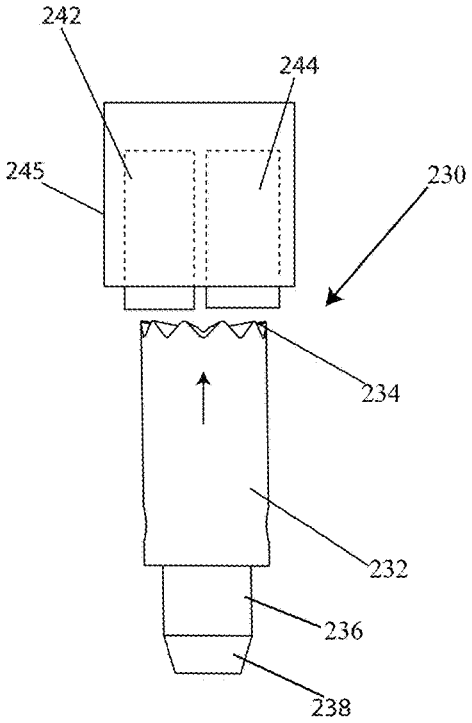
FIG. 22B
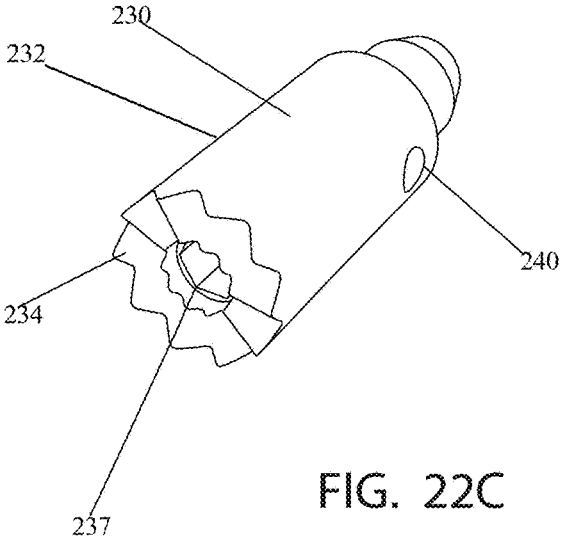
FIG. 22C
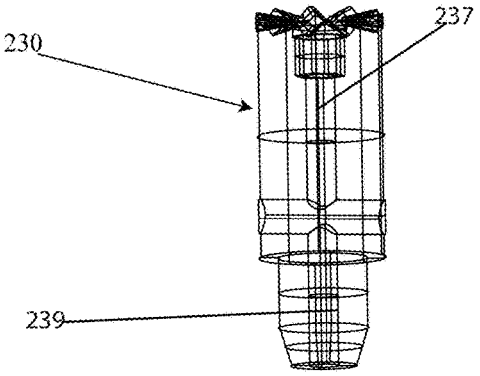
FIG. 22D
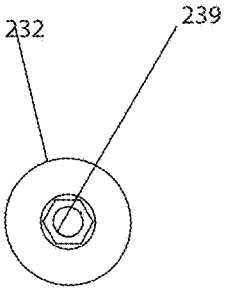
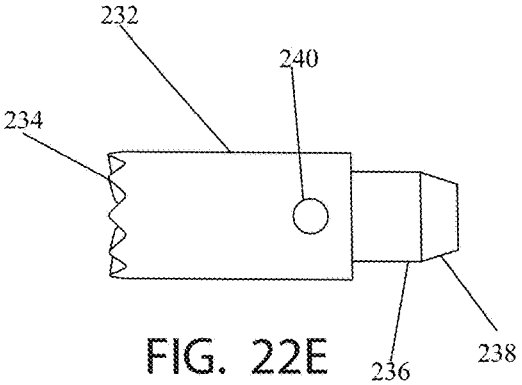
FIG. 22E

SELECTIVELY CLOSABLE HINGE

CROSS REFERENCE TO RELATED APPLICATIONS

This application is a non-provisional application which hereby claims priority from U.S. Provisional Patent Application Ser. No. 62/559,382 filed on Sep. 15, 2018, and US. Provisional application 62/620,976 filed on Jan. 23, 2018, the disclosures of which are hereby incorporated herein by reference in their entirety.

BACKGROUND OF THE INVENTION

The invention relates to a self-closing hinge which can be selectively activated via any number of environmental changes such as heat and/or fire.

SUMMARY OF THE INVENTION

In at least one embodiment, there is a temperature activated spring hinge comprising hinge section comprising at least one door leaf and at least one hinge leaf. There is also a fuse which is configured to react in response to an elevated temperature. The fuse can be positioned inside one of the knuckles of the door leaf. There is also a biasing element configured to bias the hinge in a closed position. In at least one embodiment the biasing element is a spring. There is also at least one guide configured to guide a movement of the hinge when the hinge moves from an open position to a closed position.

In at least one embodiment the open position of the hinge is when the door leaf is pushed away from said at least one hinge leaf in a rotational manner. In at least one embodiment the fuse is a fusable pin and is substantially cylindrical. In at least one embodiment, at least one knuckle of the door leaf or the hinge leaf has at least one channel configured to receive the fusible pin.

In at least one embodiment there is at least one locking pin wherein the locking pin is disposed adjacent to the fusible pin. In at least one embodiment, the locking pin is configured to move when the fuse is broken, and wherein the locking pin is configured to move from a locked position to an unlocked position when the fuse is broken.

In at least one embodiment, the locking pin moves from a locked position to an unlocked position, the fire door hinge is configured to move from an open position to a closed position.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 6A is a side view of a gear block;

FIG. 6B is a second perspective view of the gear block;

FIG. 6C is a base part of the main body;

FIG. 6D is a spring of the main body in a side view;

FIG. 6E is a side-bottom perspective view of the spring shown in FIG. 6C;

FIG. 9A is a side view of the end body;

FIG. 9B is a top view of the end body;

FIG. 9C is a perspective transparent view of the end body;

FIG. 9D is a side view of the end body;

FIG. 9E is a side perspective view of a bearing;

FIG. 9F is a side perspective view of a bearing;

FIG. 18A is a side view of a leaf;

FIG. 18B is a side perspective view of a bearing;

FIG. 18C is a side perspective view of a similar bearing;

FIG. 18D is a side perspective view of another bearing;

FIG. 22A is a side view of another alternative embodiment of a gear;

FIG. 22B is a perspective end view of the gear shown in FIG. 22A;

FIG. 22C is a side transparent view of the gear of FIG. 22A;

FIG. 22D is an end view of the gear; and

FIG. 22E is a side view of the gear.

DETAILED DESCRIPTION OF PREFERRED EMBODIMENTS

Figure 1:
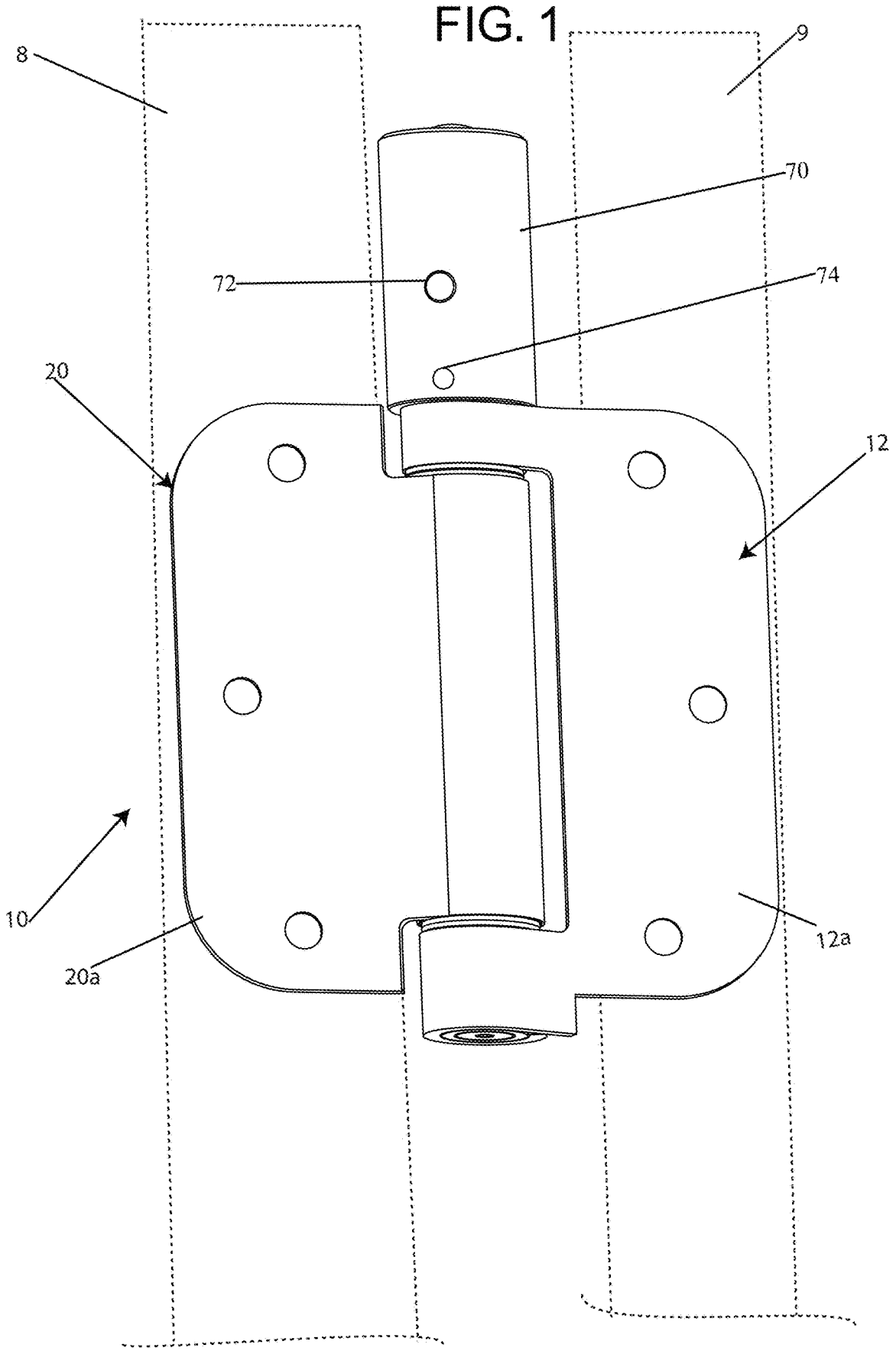
FIG. 1 is a first side view of the hinge.

Referring to the drawings, FIG. 1 shows a first side view of the hinge 10. This hinge 10 includes a first hinge 12 having a leaf 12*a* and a second hinge 20 having a leaf. Second hinge 20 has a leaf 20*a* is coupled to a door 8 while the first hinge 12 has a leaf that is coupled to a door frame 9. There is also an end section 70 with openings 72 and 74 for receiving pins extending there-through. In another embodiment first hinge 12 is configured to be coupled to a door and a second hinge 20 is configured to be coupled to a door frame.

Figure 2:
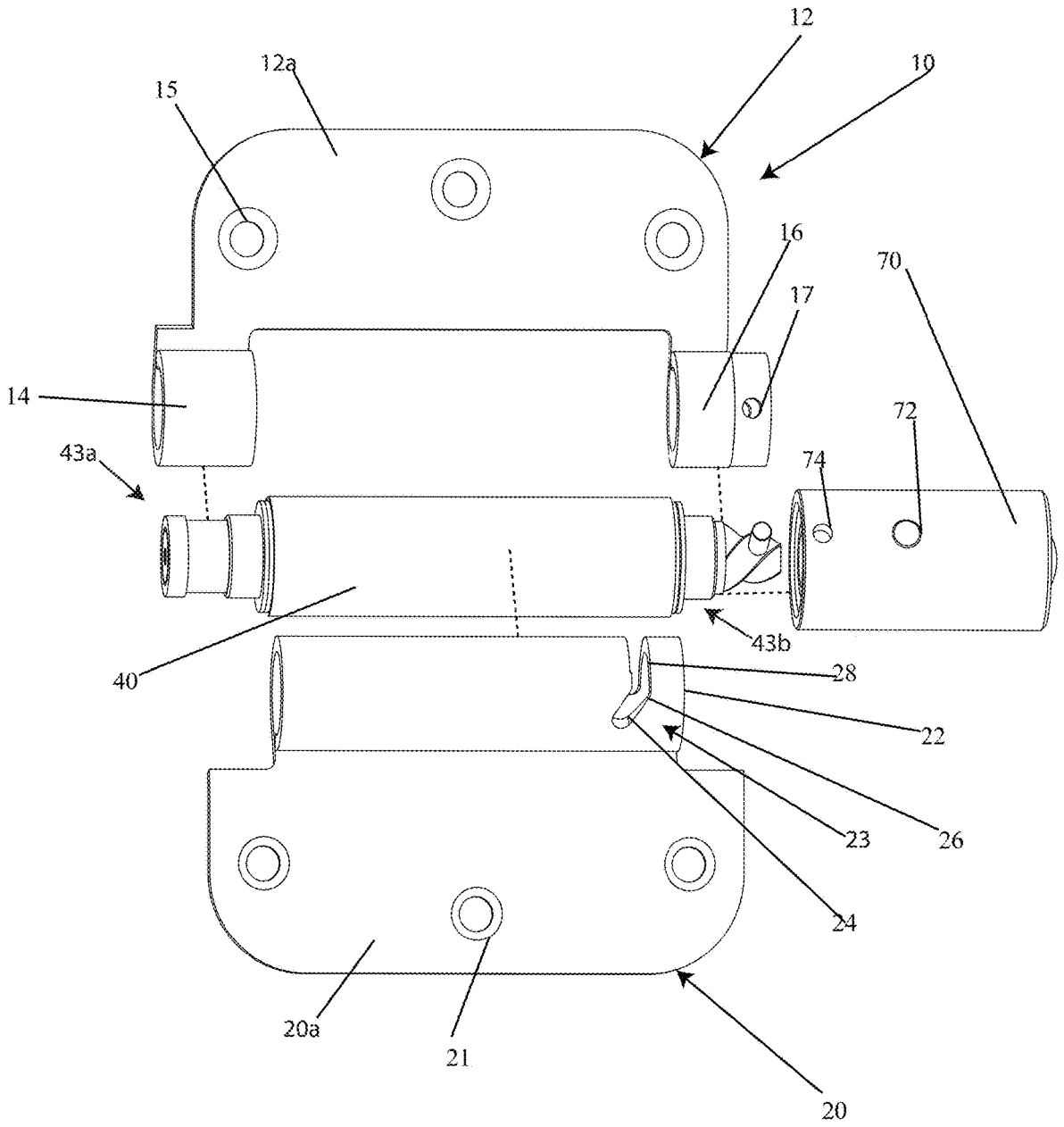
FIG. 2 is an exploded side view of the hinge shown in FIG. 1.

FIG. 2 is an exploded side view of the hinge shown in FIG. 1, in this view there is the hinge 10 having hinge 12 and hinge 20 wherein hinge 12 has leaf 12*a*, knuckles 14 and 16, a plurality of screw holes 15 along with a pin hole 17. Hinge 20 includes a leaf 20*a* having a plurality of screw holes 21 as well as a knuckle body 22. Disposed in knuckle body 22 is a groove 23. Groove 23 includes an angled section 24, an angle point 26 and a straight, or when the hinge is positioned along a vertical axis, a horizontally extending section 28. Knuckle body 22 is configured to cover a main body section 40.

In addition, positioned adjacent to the hinges 12 and 20 and the main body 40 is end section 70. End section 70 includes at least two pin holes 72 and 74.

Figure 3:
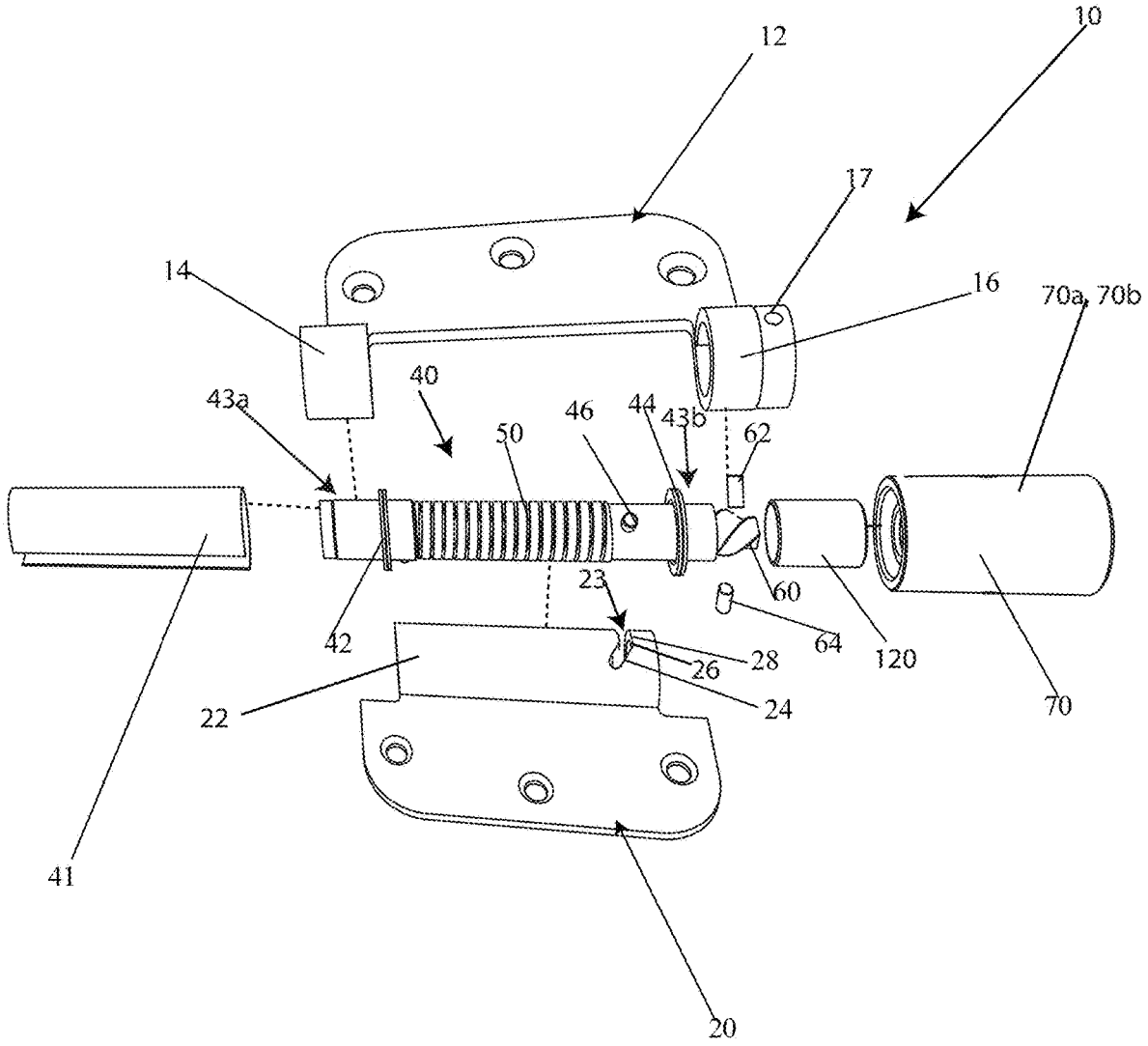
FIG. 3 is a further exploded side view of the hinge shown in FIG. 1.

FIG. 3 shows a further exploded view of the device which shows hinges 12 and 20 which shows leaf 12 having knuckles 14 and 16 with hole 17 in knuckle 16. It also shows hinge 20 with knuckle 22 having groove 23 with angled section 24 and horizontal section 28. There is a cover 41 for body section 40 wherein cover 41 has a slot to receive hinge 20. Cover 41 covers over the different sections of body section 40. For example, there is a first end section 43*a* and a second opposite end section 43*b* and a pin 46. A spring 50 is coupled to the body section 40 between the end sections 43*a* and 43*b*. Coupled to the main body 40 is a gear 60. The gear 60 can be in any form however in at least one embodiment is in the form of a tapered worm gear or self-threading screw. Disposed adjacent to worm gear 60 are locking pins 62 and 64 which fit inside of respective holes 17 on knuckle 16. Positioned in a region of first section 43*a* is a first set of bearings 42, while at the second end section 43*b* are a second set of bearings 44 and 66.

End section 70 is shown with bushing 120 disposed adjacent to it. Bushing is configured to fit inside of knuckle 16 and 22.

Figure 4:
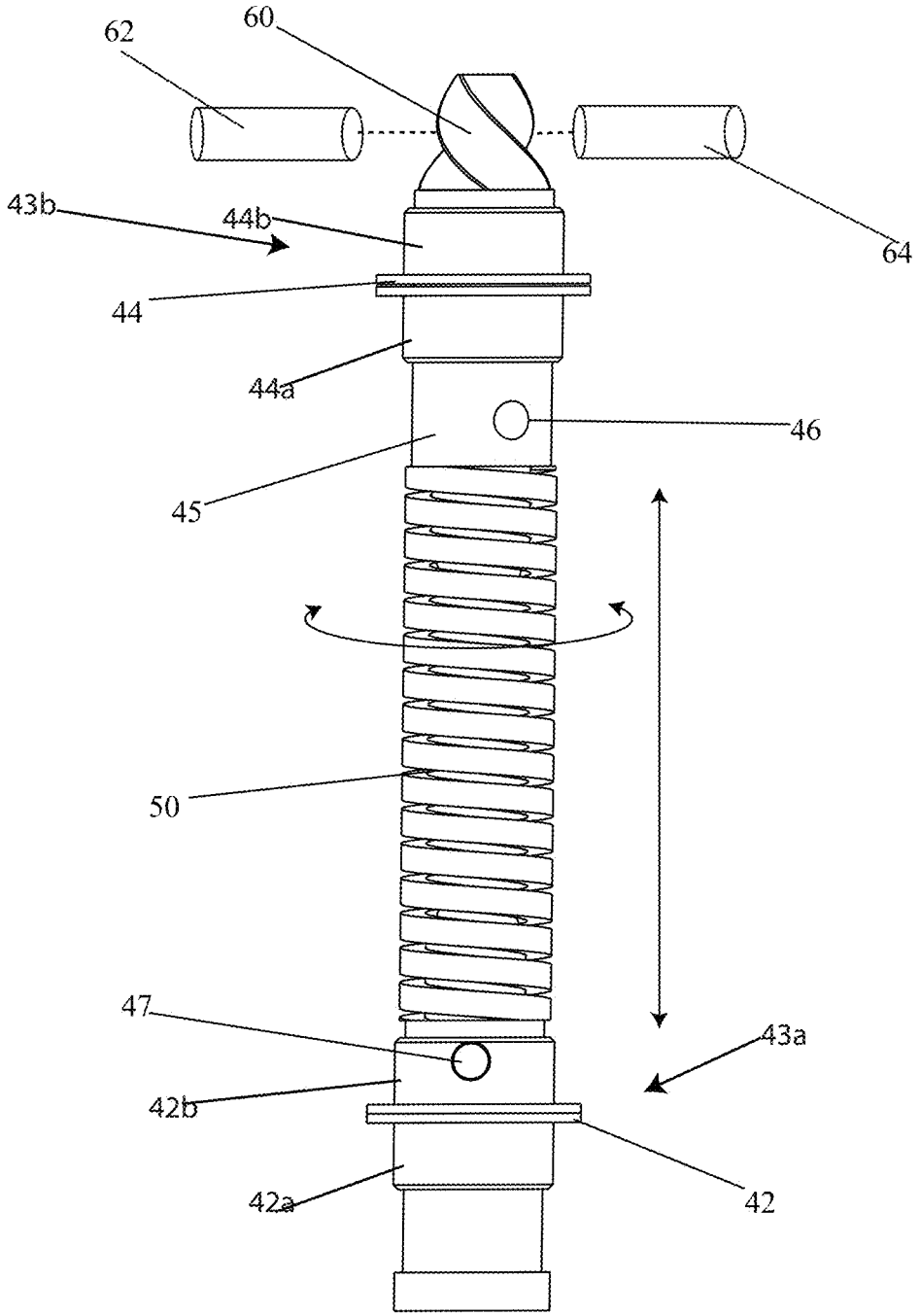
FIG. 4 is a side view of a main body of the hinge of FIG. 3.
Figure 5A:
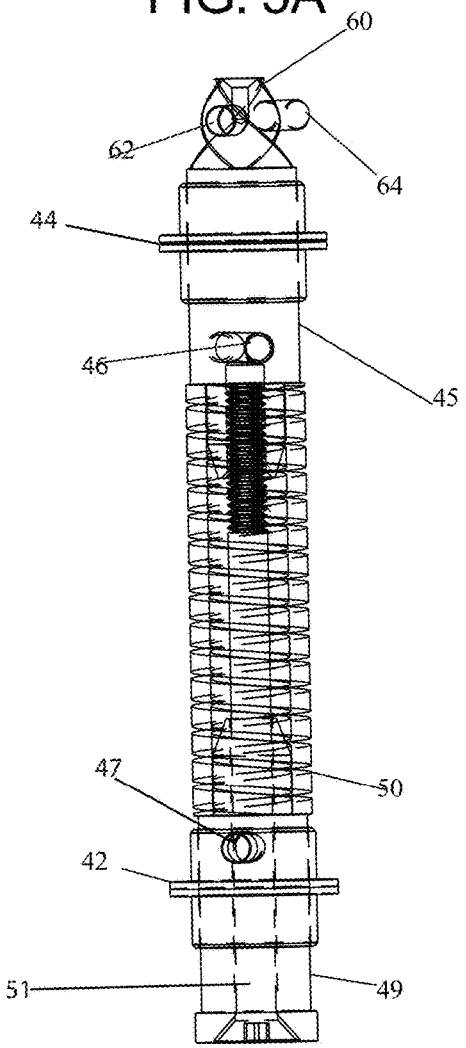
FIG. 5A is a side transparent view of the main body shown in FIG. 4.

FIGS. 4 and 5 show a side view of the body section 40 with the cover 41 removed. In this view there is shown first end section 43*a* which is positioned opposite second end section 43*b*. Bearings 42 and 44 are respectively positioned at each end section 43*a* and 43*b*. Bearing 42 actually comprises a first bearing 42*a* and a second bearing 42*b*. Bearing 44 comprises a first bearing 44*a* and a second bearing 44*b*. A pin 47 is positioned adjacent to first end section 43*a*. This pin is configured to lock first end section 43*a* to knuckle 22 on hinge 20. Positioned adjacent to pin 47 is a spring 50 which in at least one embodiment is in the form of a coil spring and which is normally biased in a compressed state and rotationally pre-loaded state when the hinge is not engaged with a drive mechanism. There is a mid-section 45 and a pin 46 coupled to mid-section 45. Pin 46 is configured to move inside of groove 23 from a first position wherein the spring 50 is compressed and preloaded torsionally, to a second position where the spring is expanded when the hinge is engaged into a drive position. This movement is shown by both the vertically axially oriented arrow, and the rotational horizontally positioned arrow as well. While pin 46 is described as moving, knuckle 22 actually moves relative to pin 46 because when the door is in an engaged position, gear 60 is locked to hinge 12 thereby locking pin 46 relative to rotation. Positioned adjacent to second end section 43*b* is a gear 60. As shown FIG. 5 shows a transparent view with dotted lines being elements normally hidden from view. When the drive is engaged, while end 43*b* is locked, opposite end 43*a* is driven in a rotational manner by spring 50. Because opposite end 43*b* is locked to knuckle 22, spring 50 drives knuckle 22 and thereby hinge 20 relative to hinge 12 to a position where both leaves are then positioned adjacent to each other and a door is then in a closed position.

Figure 5B:
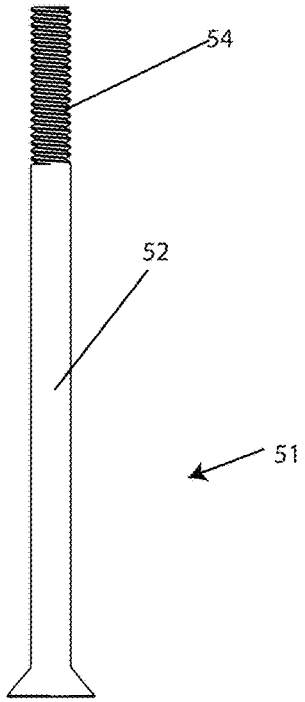
FIG. 5B is a side view of a bolt that is used temporarily until installation.

FIG. 5B is a side view of a locking bolt 51 which has a base section 52 and a threaded section 54. This bolt can be shipped with the hinge and used for initial installation of the hinge on the door. This bolt allows the top portion 70 to be inserted onto the remaining portion of the hinge while keeping pin 46 stationary and the spring preloaded. Once the hinge is installed, bolt 51 is removed from the hinge and the hinge is now available to be operational.

Figure 5C:
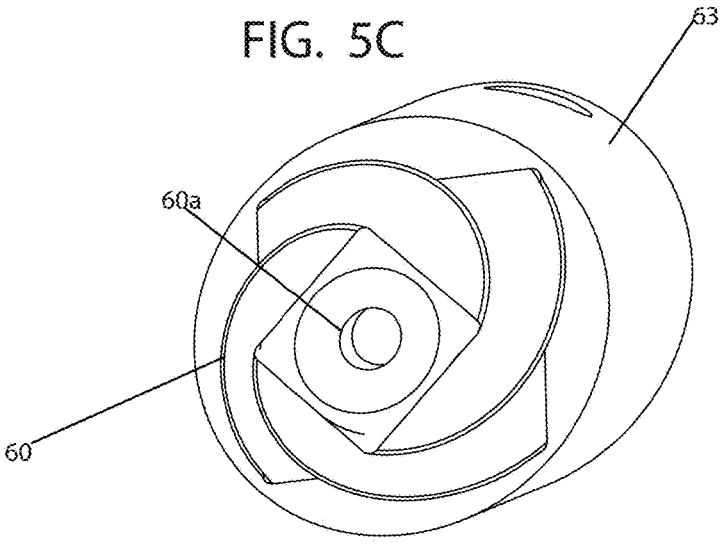
FIG. 5C is a top perspective view of the gear.
Figure 17A:
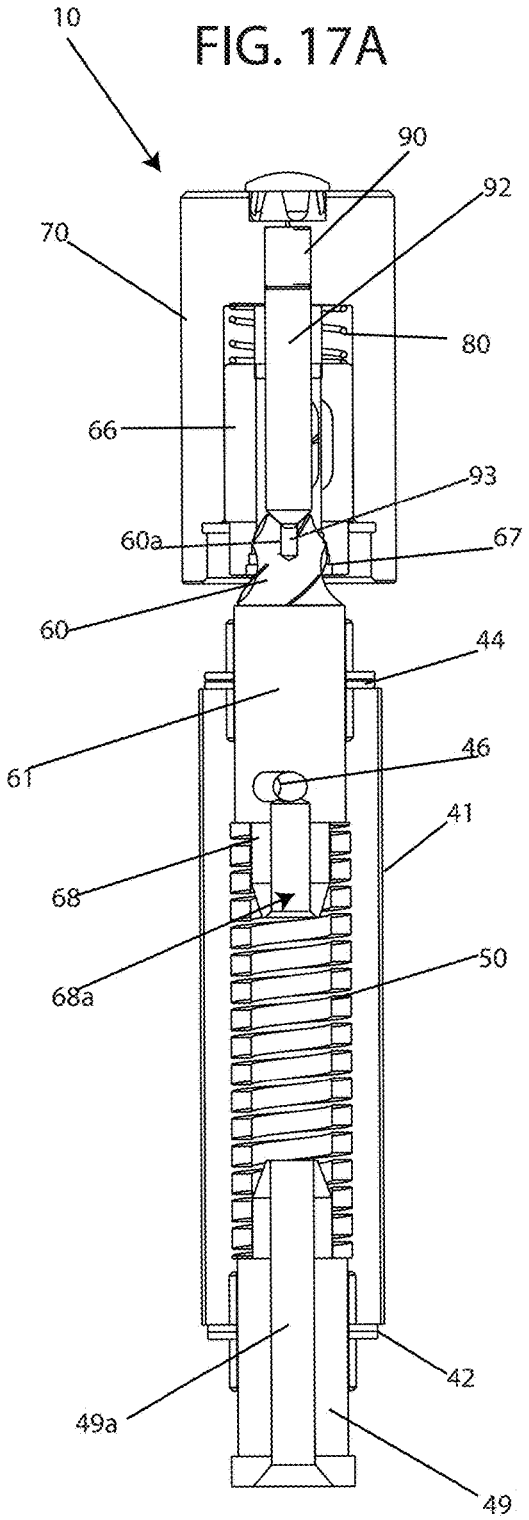
FIG. 17A is a side cross-sectional view of the first embodiment.
Figure 17B:
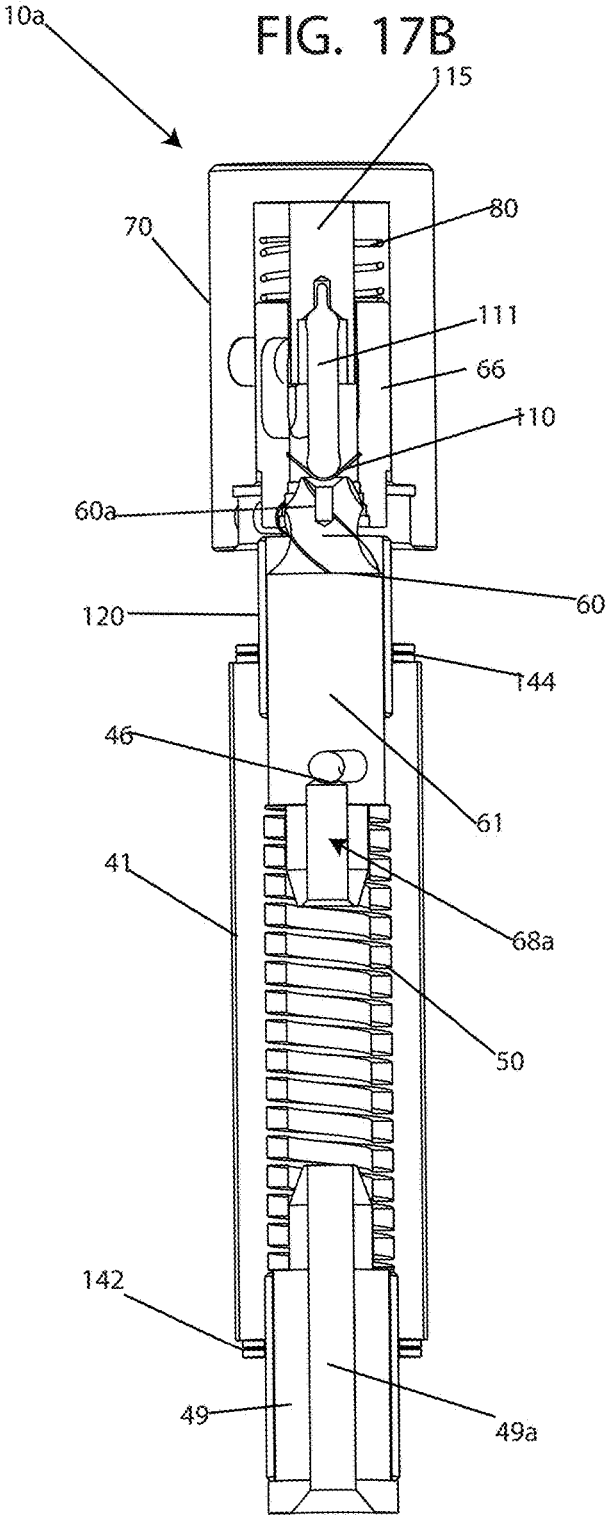
FIG. 17B is a side cross-sectional view of the second embodiment.

FIG. 5C is a top perspective view of the gear 60 which includes gear body 63, gear portion 60 and a hole or receptacle 60*a* configured to receive a tip on drive pin 92 or frangible bulb end 111 and bearing surface 110 (See also FIGS. 17A and 17B).

FIG. 6A is a gear part of the main body which includes a gear block 61 having a gear 60, as well as a pin hole 69, and a tapered end shaft 68. Pin hole 69 is configured to receive pin 46. The tapered end section (labeled 68*a* on the right) is configured to receive a threaded end section 54.

FIG. 6B is a perspective view of the gear block 61 having an end 68*a* and an end opening 68*b*. End 68*a* forms a platform adjacent to tapered end shaft 68. In FIG. 6*a*, surface 68 is what interfaces with the spring inner diameter. End 68*a* is a surface for connecting to the coil spring 50, particularly end 50.2 of coil spring 50.

FIG. 6C is a base part of the main body which includes an inside body 51, which includes a bolt 52, having a threaded shaft section 54, a locking pin 47 and an end body 49 which is positioned adjacent to first end section 43*a*. Spring 50 is shown in FIGS. 6D and 6E as a coil spring and fits over bolt 52 and threaded shaft section 54.

Figure 7A:
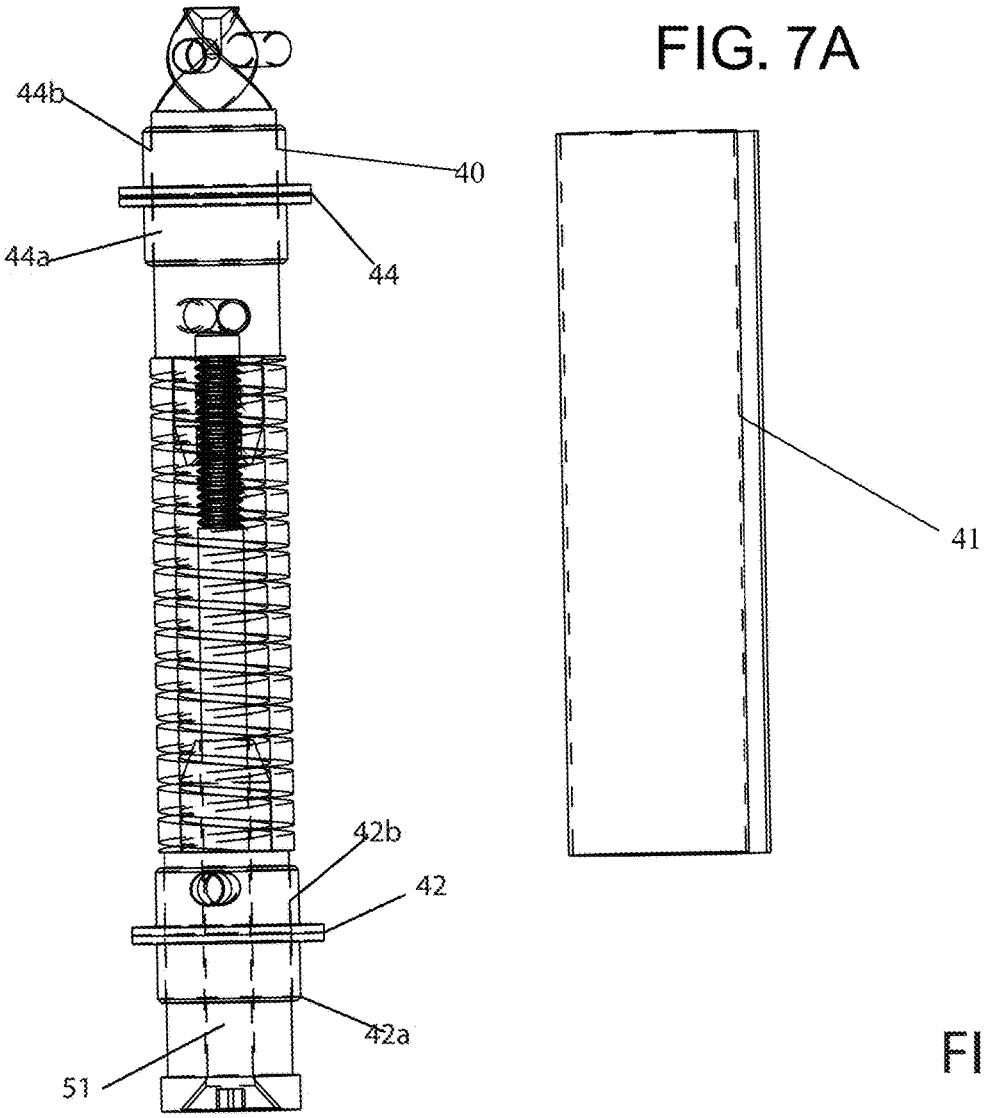
FIG. 7A is an exploded transparent view of the hinge body and end section of a first embodiment.
Figure 7B:
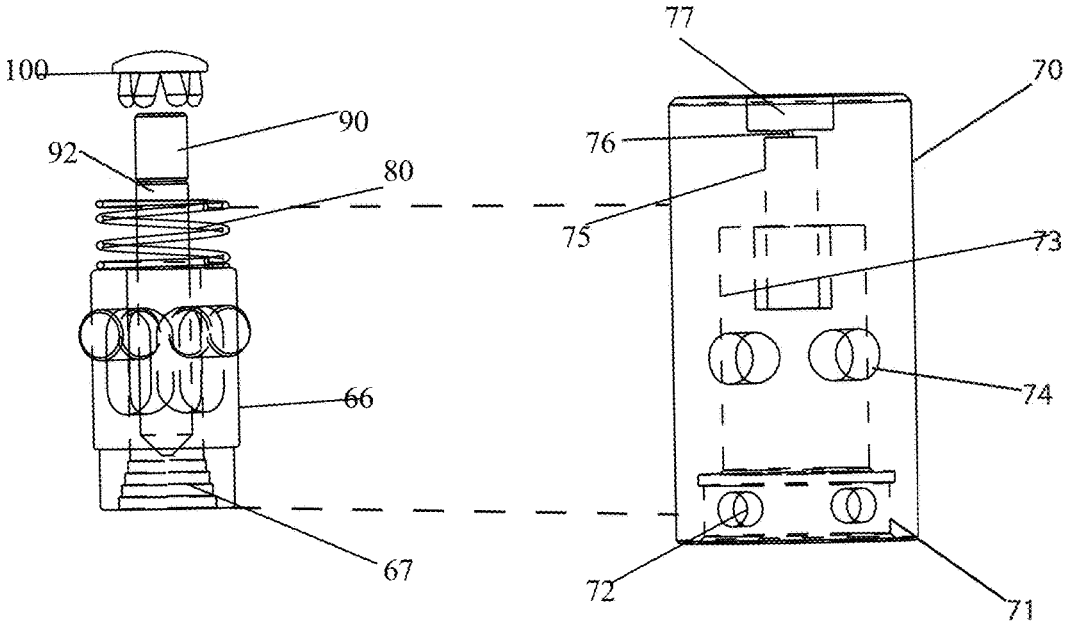
FIG. 7B is an exploded transparent view of the head section of the hinge.

FIGS. 7A and 7B is an exploded transparent view of the hinge body and end section of a first embodiment. With this view there is shown body section 40, cover 41, and end section 70 having a cover with pin holes or openings 72 and 74 as well as a plurality of different body sections including a first body section 71, a second body section 73, a third body section 75, which is configured to receive a fuse, a pinhole channel 76 and a vacant reservoir 77 which is configured to receive the fuse after it flows through the pinhole channel 76 and into the reservoir. Second body section 73 is configured to receive receiving element or sliding block 66.

There is also shown sliding block 66 which includes a tapered section 67, wherein contoured or tapered section 67 is configured to receive gear 60. There is also a spring, in the form of a coil spring 80, along with a drive pin 92 and a fuse 90. An end cap 100 is also shown. End cap 100 is configured to fit into an end of the end section 70, to cover reservoir 77. Sliding block 66 is configured to be fixed rotationally but selectively movable axially along pins 82 and 84, from a first position to a second position wherein as sliding block comes into contact with gear 60, it drives sliding block from the first position to the second position wherein as the sliding block approaches the second position, the gear 60 locks with the sliding block 66.

Figure 8:
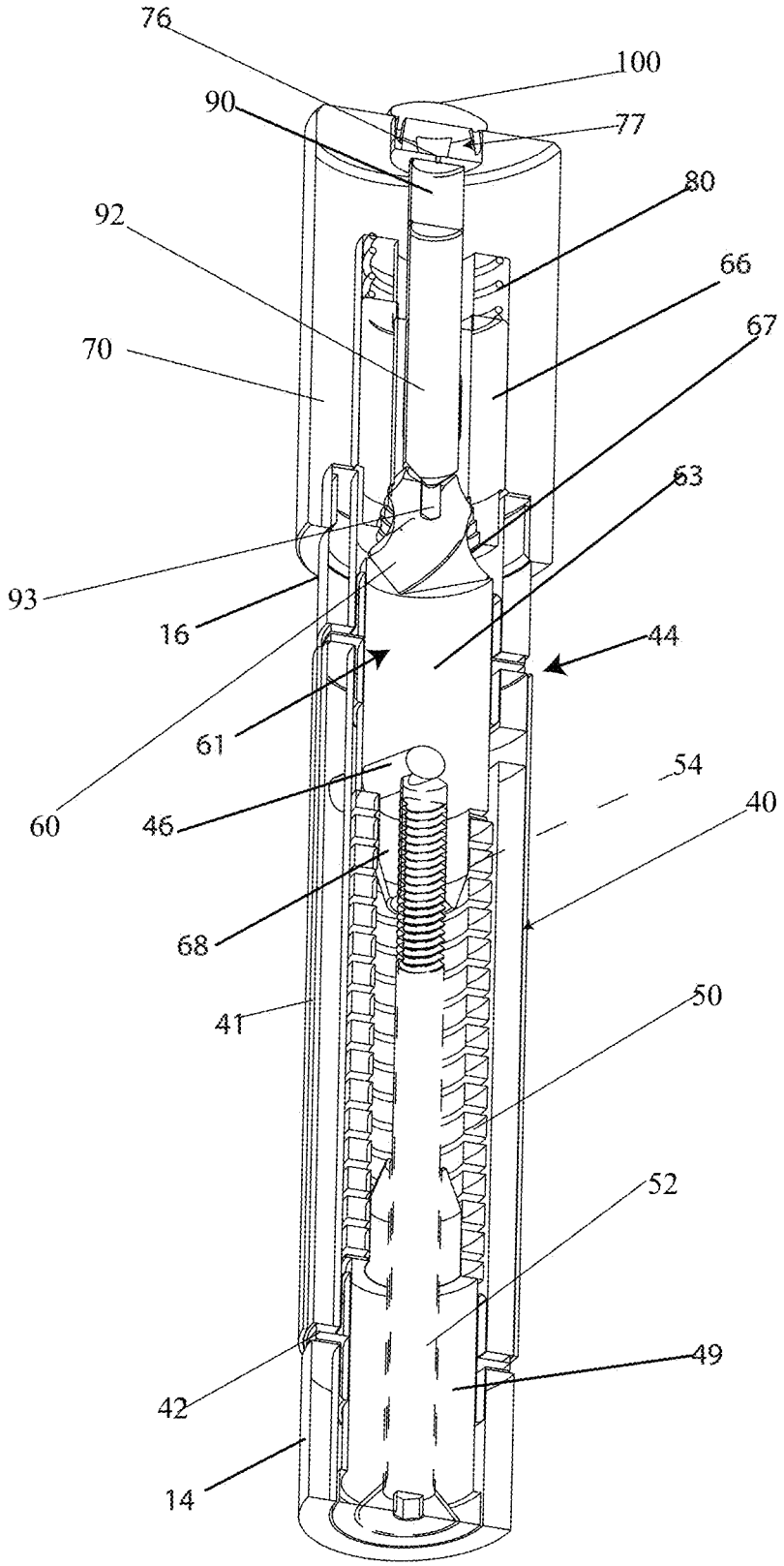
FIG. 8 is a side cross-sectional view of the hinge body and end section of a first embodiment.

FIG. 8 is a side cross-sectional view of the hinge body and end section of a first embodiment. With this view there is main body section 40 having cover 41, spring 50 disposed inside cover 41 a bolt 52 having a threaded shaft section 54, a main body section 63 of gear block 61. Pin 46 is shown extending into main body section 63, into hole 69 (See FIG. 6A). Gear 60 is shown coupled to body section 63, and is configured to receive shaft 92, particularly pointed section 93 which inserts into a top section of gear 60. Gear 60 fits inside of contoured section 67 of receiving sliding block 66. Gear block 61 receives the threaded section 54 of bolt 52 in threaded region 68. As shown receiving housing houses shaft 92, while fuse 90 fits inside of section 75 of end section 70.

FIG. 9A is a side transparent view of an end body 49. FIG. 9B is an end view, FIG. 9C is a perspective view, and FIG. 9D is another side transparent view. In these views the end body includes a first beveled region 49*a*, a second region 49*b*, a third base region 49*c* which is wider than the second region 49*b*. Section 49*b* is coupled to the one end of the spring 50 such as end 50.1. There is a hole 49*d* in the third region 49*c* running transverse to a longitudinal axis 49*i*. There is another hole 49*e* that runs along longitudinal axis 49*i*. A surface 49*f* is formed when region 49*b* meets region 49*c*. This surface 49*f* is configured to be coupled to spring end 50.1 while surface 49*c* is configured to be coupled to bearings such as bearings 42.

FIG. 9E is a side perspective solid view of a bearing such as any one of bearings 42 or 44 such as 42*a*, 42*b*, 44*a*, 44*b*. Each bearing has for example a flared region such as region 42.1 and a cylindrical hollow region 42.2 for any one of bearings 42*a* or 42*b*. Bearings 44*a* or 44*b* can have a flared region 44.2 and a cylindrical region 44.2. These bearings allow different components to slide adjacent to each other so that there is reduced friction between different components.

Figure 10A:
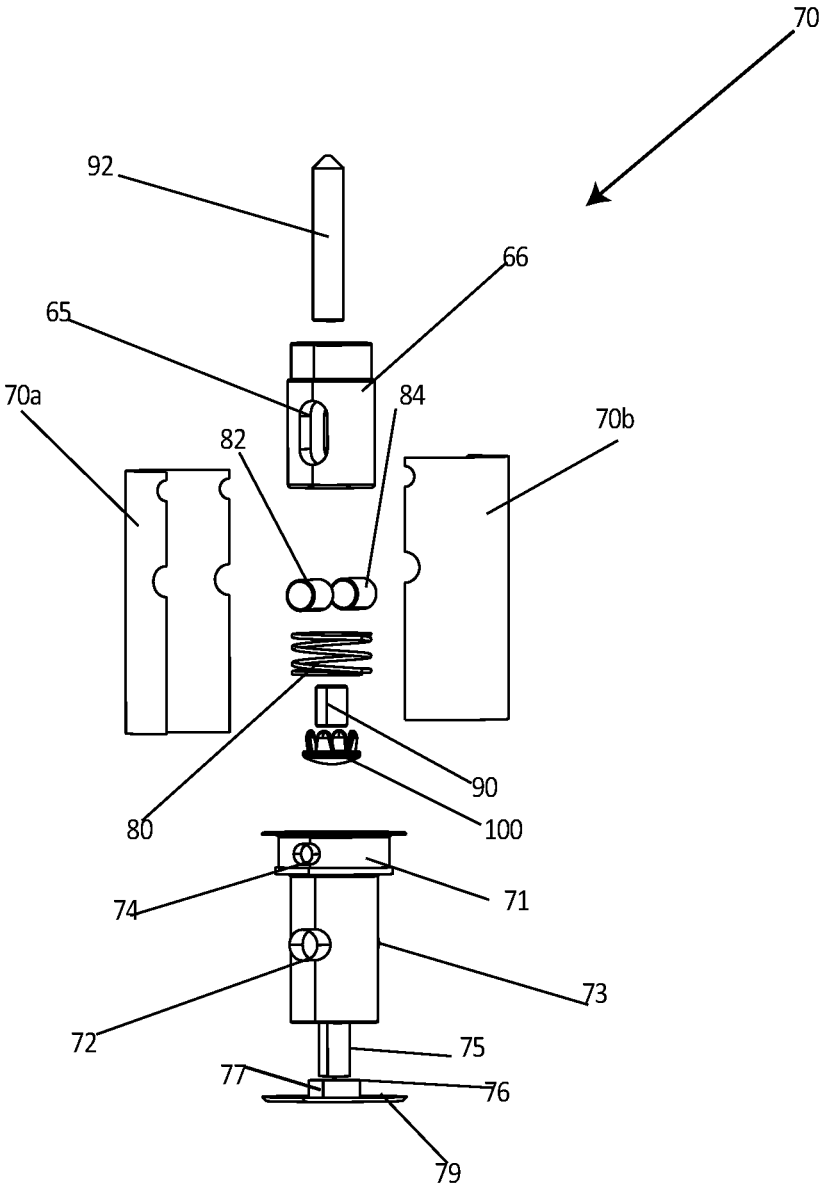
FIG. 10A is an exploded view of the end section of a first embodiment.
Figure 10B:
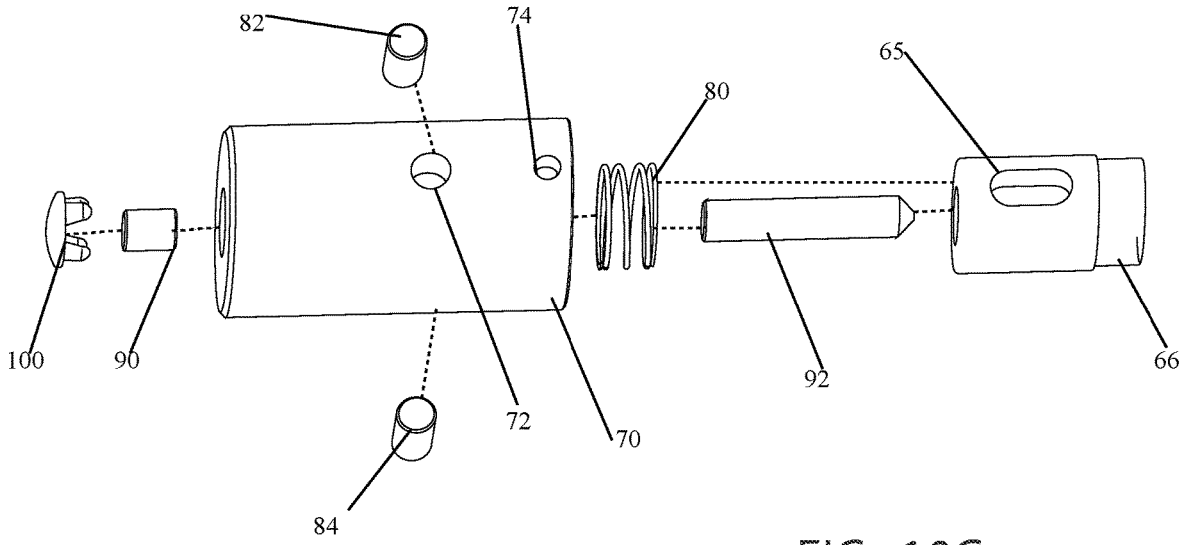
FIG. 10B is a side exploded view of the first embodiment of an end section.
Figure 10C:
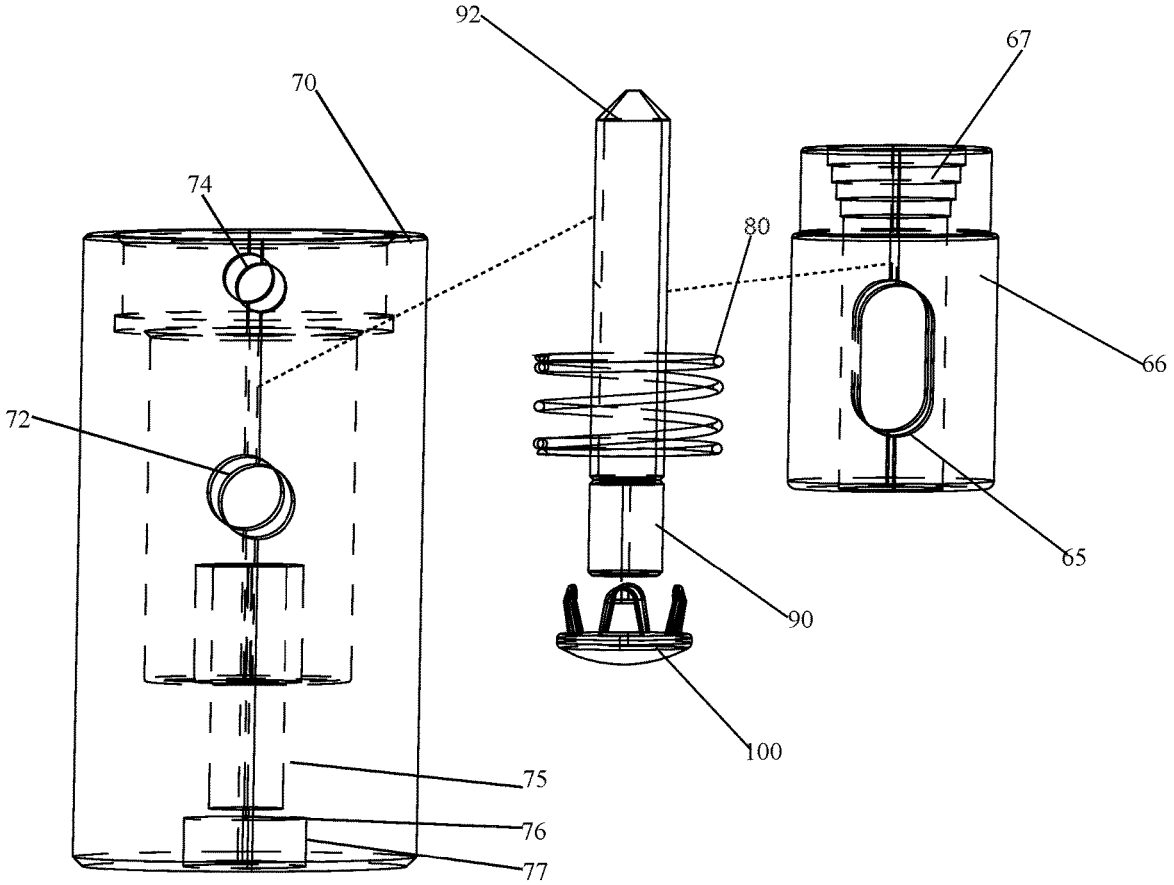
FIG. 10C is a side transparent view of the end section.

FIG. 10A is an exploded view of the end section of a first embodiment of end section 70 which shows receiving sliding block 66, having a slot or groove 65 for receiving pins 82 and 84. Cover sections 70*a* and 70*b* form a cover over this section and are configured to house a housing portion including a first body section 71, a second body section 73, as well as openings 72 and 74. Opening 72 is for receiving pins 82 and 84. Spring 80 is configured to fit inside of second section 73 while fuse 90 fits inside of section 75. Spring 80 sits adjacent to receiving sliding block 66. Sliding block 66 is configured to move axially along groove 65 sliding with pins 82 and 84 to guide them. This axial movement compresses coil spring 80 but allows gear 60 to move into an engagement position engaging hinge 12 and causing hinge 20 to drive to a closed position. This is because hinge leaf 12 and hinge leaf 20 are mechanically connected via spring 50 which biases the hinge leaves to close. Thus hinge 20 is then free to drive against hinge 12 to close a door. There is shown pinhole 76 configured to receive fluid flow from a fuse stored in housing section 75 and flowing into reservoir 77. An end section 79 is configured to receive end cap 100. FIG. 10B shows a side exploded wireframe rendering of these components, while FIG. 10C show a transparent side exploded view of these components. In particular FIG. 10C shows a tapered section 67 of sliding block 66. This tapered section is configured to lock with gear 60 thereby mechanically connecting hinge 20 and 12 though spring 50. Now the spring 50 is released from its initial position in groove 23 (See FIG. 2) and hinge 20 then rotates relative to hinge 12 to close a door.

Figure 11:
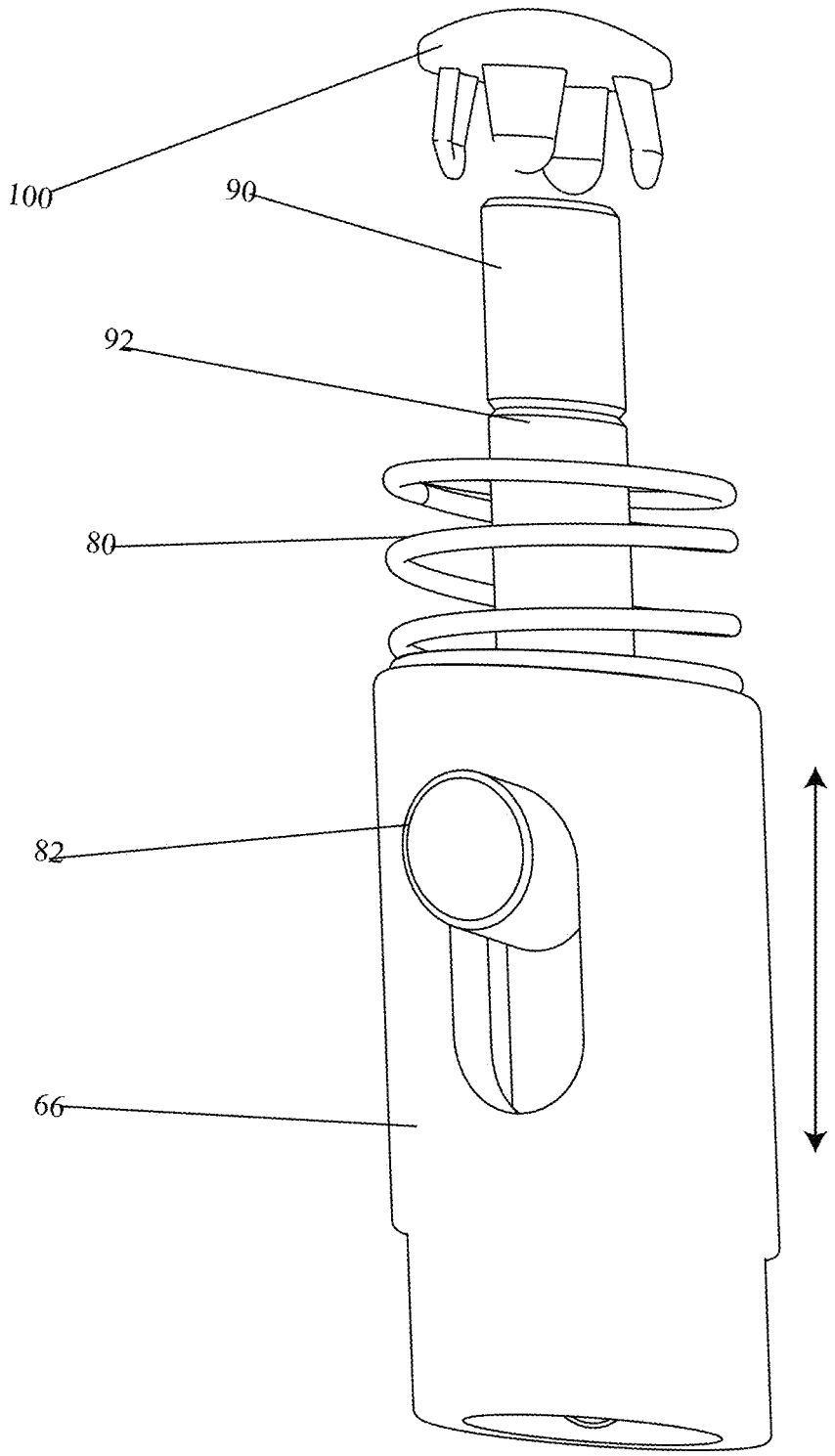
FIG. 11 is a side view of a portion of the end section with the outer body removed.

FIG. 11 is a side view of a portion of the end section with the outer body removed. With this view there is shown sliding block 66 which receives pin 82 and 84, a spring 80. Sliding block 66 is configured to be fixed rotationally but selectively movable axially along pins 82 and 84, from a first position to a second position. As sliding block 66 moves into this second position it compresses on spring 80. Wherein as sliding block comes into contact with gear 60, it drives sliding block from the first position to the second position wherein as the sliding block approaches the second position, the gear 60 locks with the sliding block 66. Because sliding block 66 is axially movable, gear 60 gradually meshes with contoured section 67, while bushing compresses spring 80 positioned on a side of sliding block 66 opposite gear 60, so that it creates a gradually increasing locking effect between gear 60 and contoured section 67 of sliding block 66.

Figure 12:
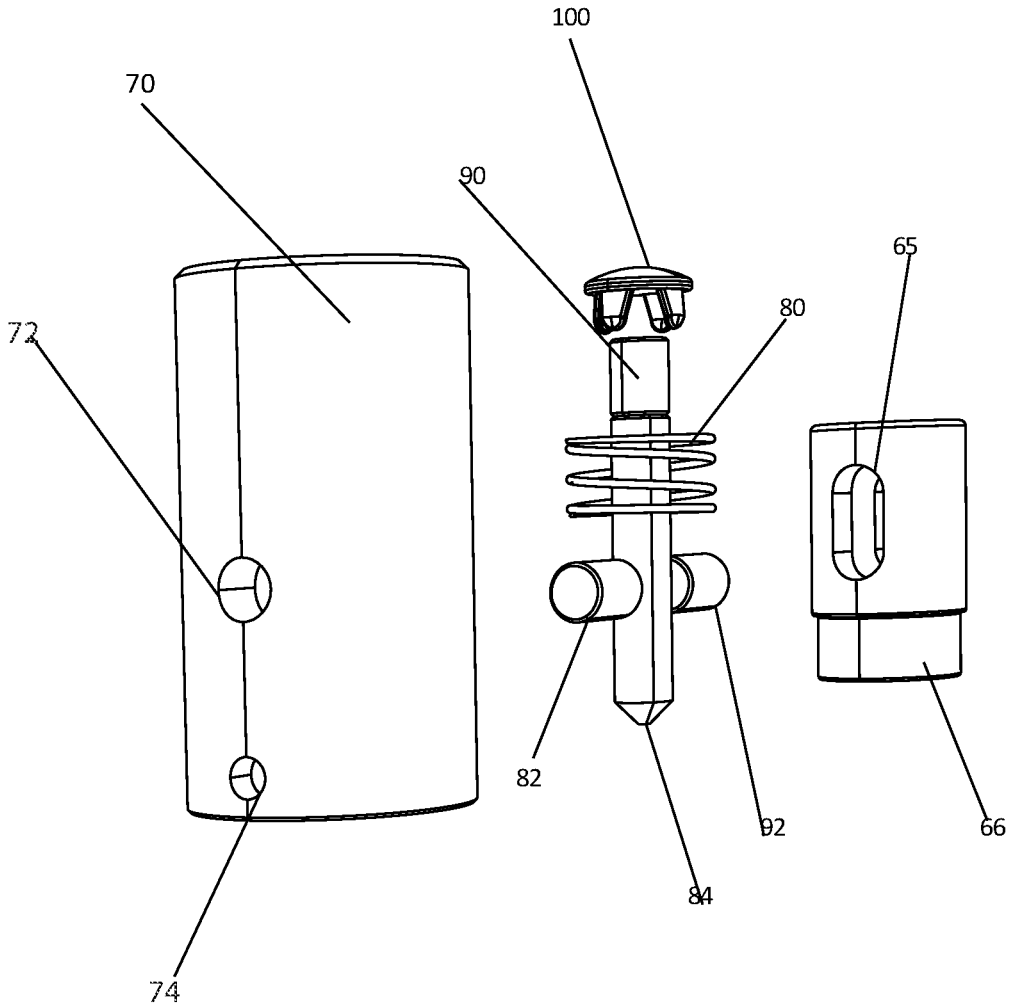
FIG. 12 is a side view of the first embodiment of the end section with the outer bodies removed from an inner section.

FIG. 12 is a side view of the first embodiment of the end section with the outer bodies removed from an inner section. This shows housing 70 having holes 72 and 74 for receiving pins, wherein pins 82 and 84 are configured to be positioned inside of holes 72. Holes 72 fix pins 82 and 84 so that they form a guide for groove 65 allowing sliding block 66 to slide axially inside of housing 70 along groove 65. There is also shown fuse 90, shaft 92, and spring 80. With this embodiment the fuse can be made from a eutectic alloy.

Figure 13:
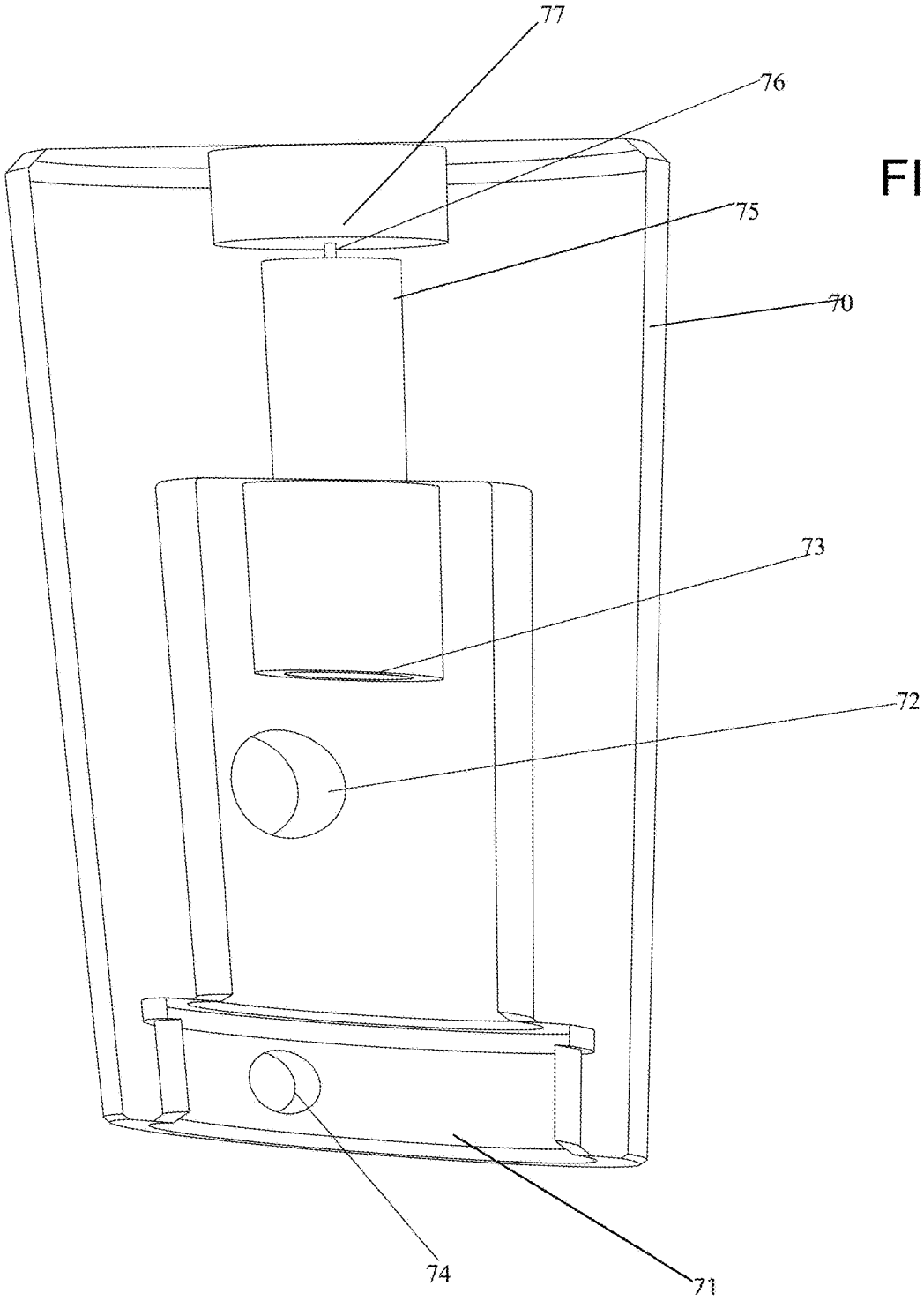
FIG. 13 is a side cross-sectional view of the end section.
Figure 14:
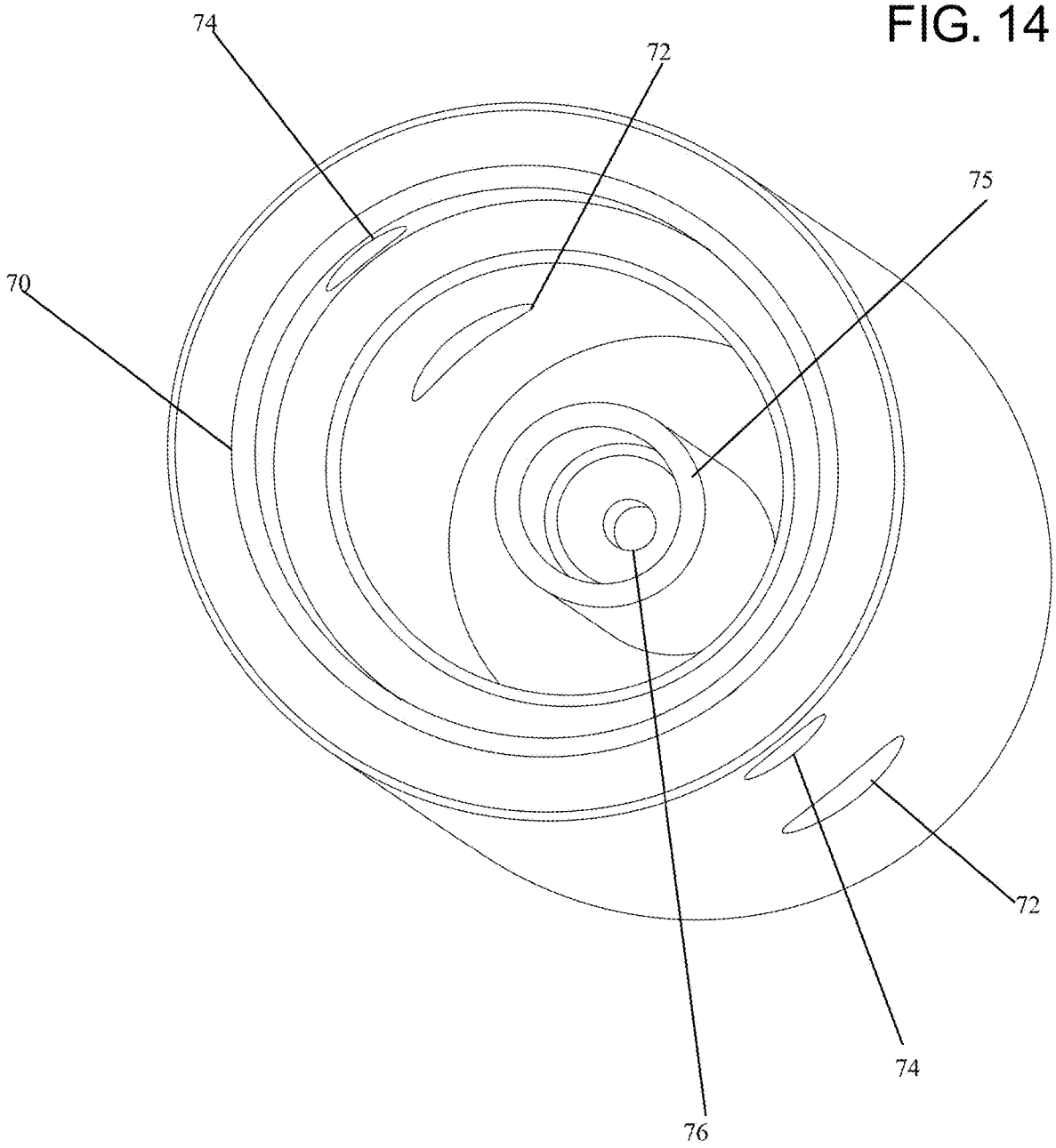
FIG. 14 is an end perspective view of the end section.

FIG. 13 is a side cross-sectional view while FIG. 14 is an end view of the end section 70 including its different sections including a first section 71, another section 73, pin holes 72 and 74, a fuse receiving section 75, a pinhole section 76, and reservoir section 77. In addition, there is a corresponding surface 71 that may be threaded to receive surface 117 of leaf 12.

Figure 15:
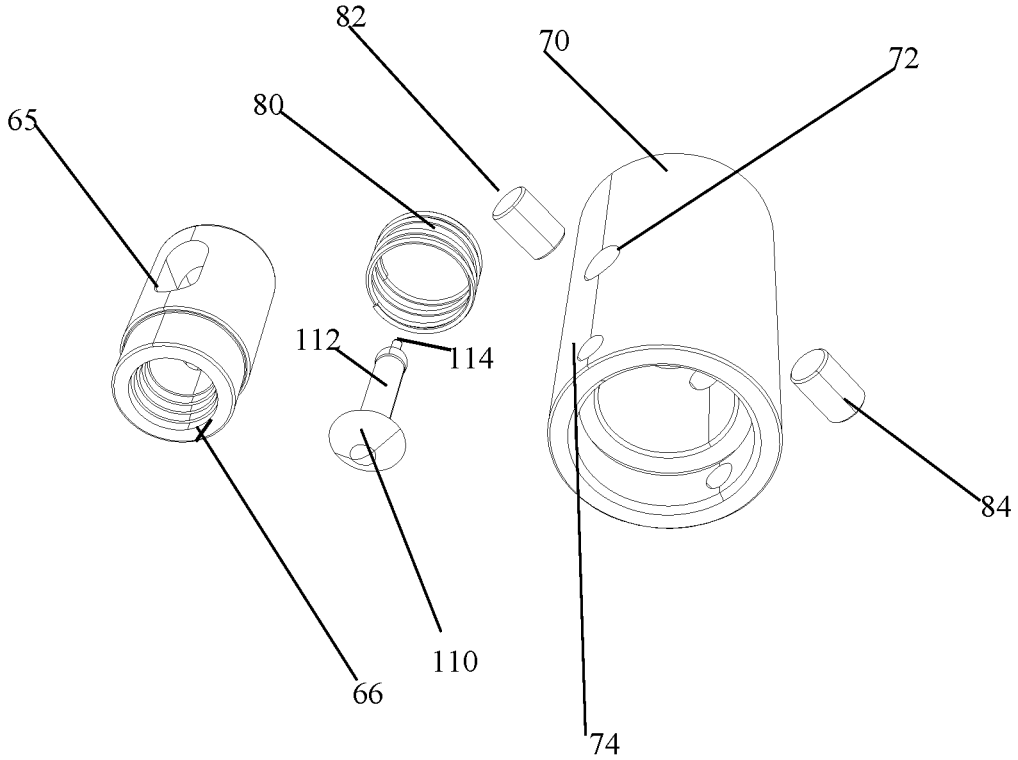
FIG. 15 is an exploded perspective view of the second embodiment.

FIG. 15 is a perspective view of the second embodiment of the end section 70. In this embodiment there is shown pins 82 and 84 which fit inside of holes 74 of the end section body. Spring 80 is disposed inside of this end section body along with sliding block 66 having channel 65. However, instead of shaft 92 and fuse 90, there is instead a frangible bulb. The frangible bulb can be encased in a thermal paste to allow for better heat transfer to the bulb. The bulb can comprise a separate flared end cap 110 forming a bearing surface configured to fit on top of gear 60, a shaft section 112, and a shaft tip 114. This flared end cap can be formed as a separate piece and is configured to retain parts of the frangible bulb and to keep it from falling into the remaining portion of the gear once the frangible bulb is compromised.

Figure 16:
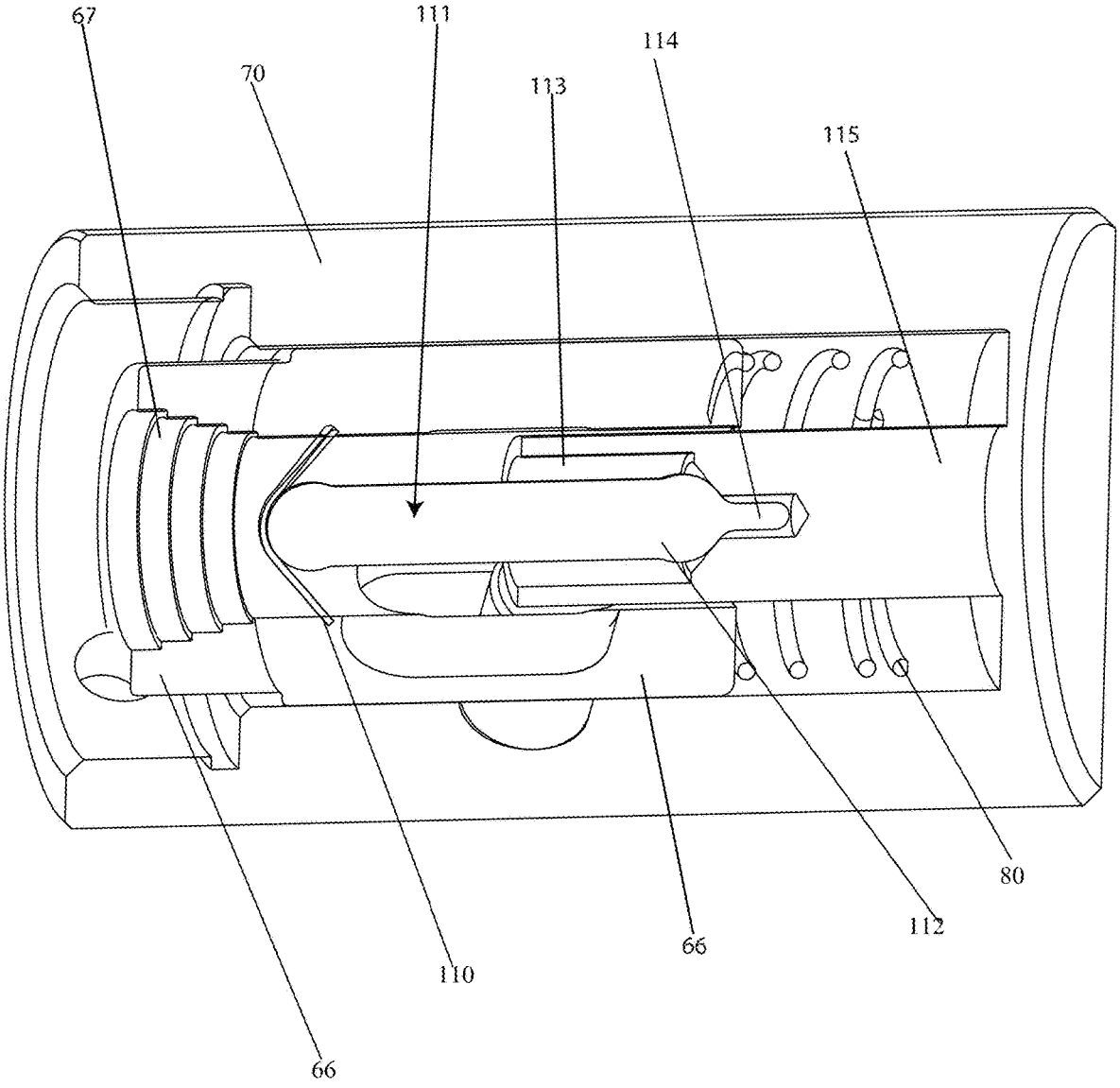
FIG. 16 is a side cross-sectional view of the second embodiment.

FIG. 16 is a cross-sectional view of the second embodiment of the end section which shows end section 70 housing sliding block 66 having contoured section 67. The frangible bulb 111 fits at least partially inside of sliding block 66. An open section 113 is configured to receive thermal paste which allows for better thermal conductivity to the frangible bulb. The frangible bulb 111 includes a separate end cap or bearing surface 110, a body section 112, and a tip 114. When the frangible bulb is heated, it can collapse, thereby allowing spring 80 to be compressed and cap or bearing surface 110 which is positioned against gear 60 to be moved axially towards spring 80, thereby allowing contoured section 67 to engage with gear 60.

FIG. 17A is a side cross-sectional view of the first embodiment 10 with the hinges 12 and 20 removed while FIG. 17B shows a side cross-sectional view of the second embodiment 10*a* with the hinges 12 and 20 removed.

The first embodiment includes a head section 70 and a body section 40. The head section 70 includes the drive pin 92 and the fuse 90. There is also shown spring 80 as well as sliding block 66. Gear 60 is shown prior to full engagement with the contoured section 67 of receiving element or sliding block 66. Gear 60 includes opening 60*a* to receive tip 93 of drive pin 92 or bearing cap 110 of frangible bulb 111. Bearings 44 are shown positioned adjacent to gear body 61 while pin 46 is shown coupled to gear body 61 as well. Tapered end section 68 has a hollowed out and internally threaded section 68*a* which is left hollow by the removal of bolt 51. Spring 50 is shown which is coupled at one end to tapered end section 68 of the gear, while the opposite end is coupled to block 49 as described above. Bearings 42 are shown while positioned between shell 41 and end block 49. End block 49 includes a hollowed-out section 49*a* which is hollow to receive bolt 51. With the second embodiment, there are a few differences. Frangible bulb 111 includes bearing surface 110 and is inserted into block 115 which extends down from housing 70. Block 115 and bearing surface 110 encases the frangible bulb such that when it is compromised, remnants are contained within. Additional bearings 144 and 120 are shown with bearings 144 being formed as disc bearings shown in greater detail in FIGS. 18B and 18C. A sleeve bearing 120 is also shown in FIG. 18D. Bearings 142 are also formed as disc bearings as well.

FIG. 18A shows a modified hinge which includes a modified threaded knuckle 117 which is threaded so that it can be screwed into threaded section 71 of adjacent head section 70. FIG. 18B shows as side view of one of the bearings 142 while FIG. 18C shows a side perspective view of one of the bearings 144 as well. These bearings can be made from any suitable material such as plastic, silicone, PVC or any suitable material.

Figure 19:
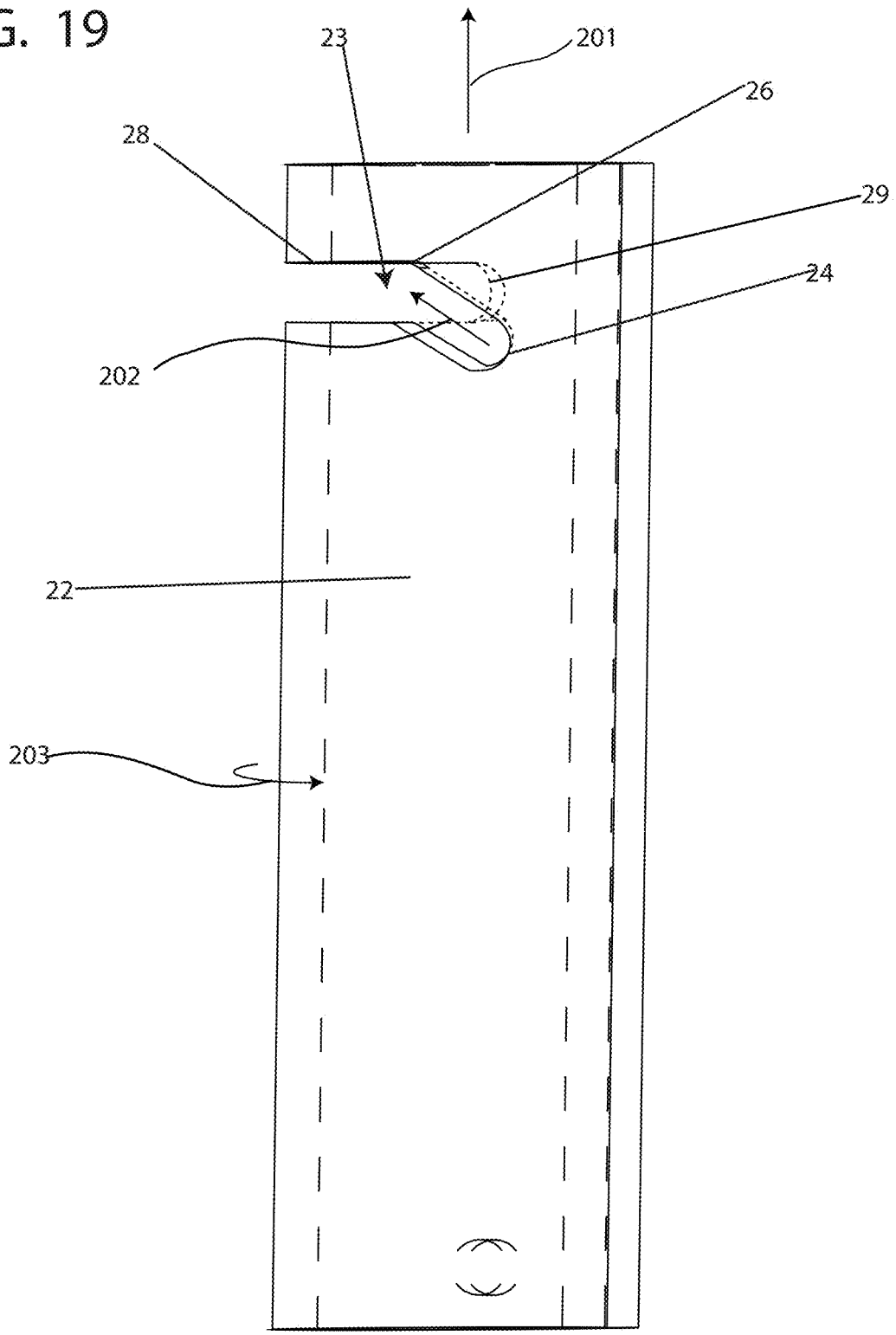
FIG. 19 is a transparent side view of the knuckle.
Figure 20A:
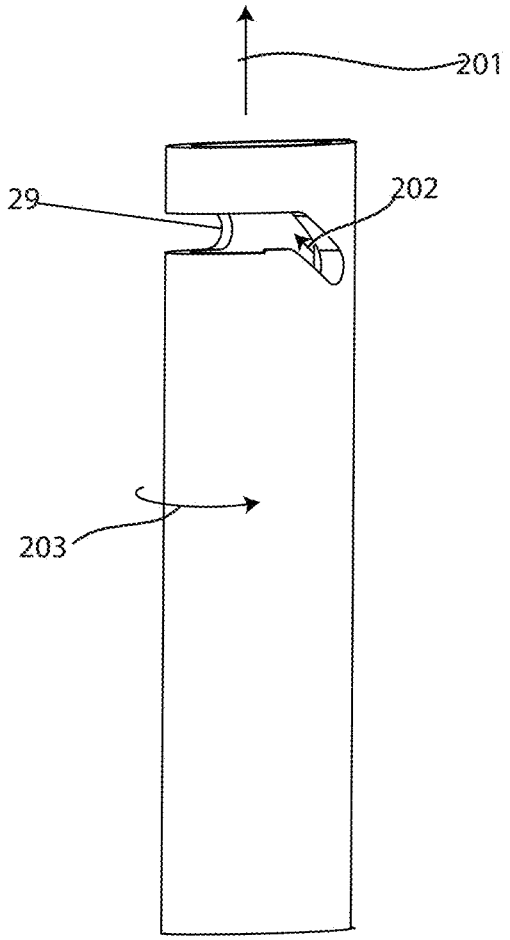
FIG. 20A is a side view of the knuckle.
Figure 20B:
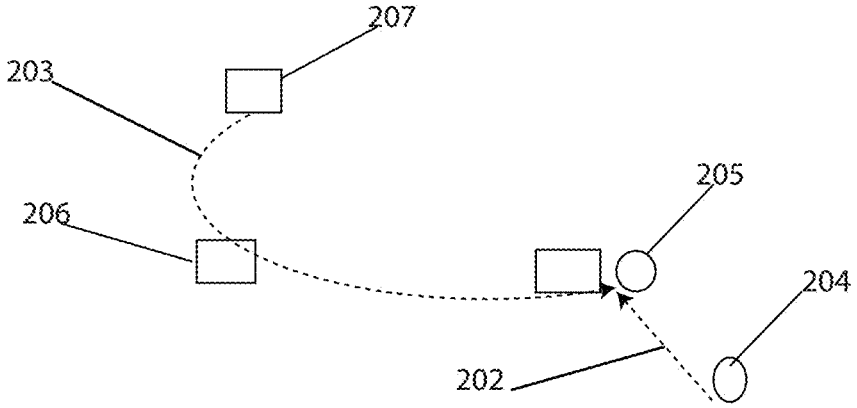
FIG. 20B is a view of the progression of the pin in the channel in the knuckle.

FIG. 19 is a side view of knuckle 22 which includes groove 23 having angled section 24, angle point 26 extending section 28 and an end 29. A shown in FIGS. 20A and 20B the movement of a pin such as pin 46 relative to knuckle 22 is first from point 204 up along angled section 24 in the direction of arrow 202, once the pin 46 reaches an angle point such as angle point 26, shown by pin position 205, knuckle 22 is driven in radial manner along curve path 203. This causes end 29 to move from position 207, to position 206 and to its final position 205 adjacent to pin 46 also in position 205. These different positions represent the movement of the pin 46 and/or the knuckle 22 as the fuse 92 or the frangible bulb 111 is compromised due to an increase in heat. The temperature at which the fuse or the frangible bulb becomes compromised could be any suitable elevated temperature which would indicate an extreme situation such as a fire. For example, the elevated temperature could be at least 120 degrees F., 130 degrees F., 140 degrees F. or any other suitable temperature. The angled rotational movement of pin 46 signifies the angled (partially axially) rotational movement of the gear 60 enmeshing with the contoured region 67 as well. As the gear 60 moves up and rotates it is gradually frictionally turning into the contoured section 67 to enmesh and then lock these two pieces together. As these two pieces are locked together, this provides a fixed end to allow for spring 50 to drive the hinge.

For example, in at least one embodiment, when pin 46 is in position 204, the hinge 12 is in a position wherein the spring is coiled but the hinge 12 is disengaged, with gear 60 not engaged with contoured region 67, this thereby allows the hinge and by extension the door to swing freely. The angled section 24 of the groove 23 forms a block or a lock that keeps the knuckle from rotating relative to the pin 46, by the substantially vertical extension of groove 23 when the hinge is installed. However, in a condition wherein the temperature is elevated, such as at above 120 degrees F., once the fuse 90 or the frangible bulb 111 is compromised, the worm gear 60 moves vertically up, against for example drive pin 92 due to the coiled pressure exerted by spring 50, and this upward movement along with the uncoiling of spring 50 causes pin 46 to move along arrow 202 to angle point 26 shown by pin position 205.

With gear 60 engaged with contoured section 67, end 50.2 of spring 50 is now fixed to leaf 12, while end 50.1 of spring 50 which is coupled to surface 49*b* causes spring torsion to be exerted between leaf 12 and 20. Because pin 47 is coupled to knuckle 22, this drives knuckle 22 to rotate and thereby close the door. Thus, further uncoiling of spring 50 results in knuckle 22 rotating as shown by arrow 203 from position 207 to position 206 to position 205 along rotational path 203 thereby closing the door.

In an alternative embodiment the frangible bulb 111 is used instead of fuse 90 and drive pin 92. Thus, once frangible bulb 111 becomes compromised, spring 50 exerts an upward pressure, pushing on end cap or bearing surface 110 of frangible bulb 111 driving gear 60 upward to be engaged in tapered or contoured section 67. With gear 60 engaged with contoured section 67, end 50.2 of spring 50 is now fixed, while end 50.1 of spring 50 which is coupled to surface 49*f* is now free to rotate. Thus hinge 20 is then free to drive against hinge 12 to close a door. Because pin 47 is coupled to knuckle 22, this drives knuckle 22 to rotate and thereby close the door.

Figure 21A:
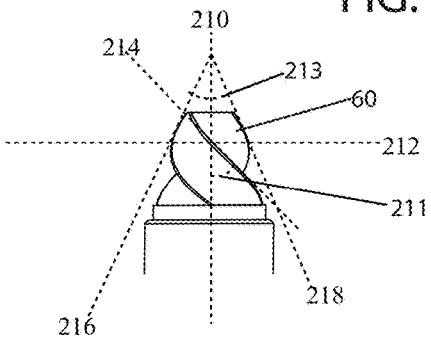
FIG. 21A is a side view of the gear with the helical angle and angles of expansion shown.
Figure 21B:
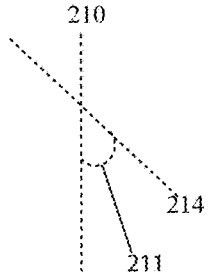
FIG. 21B is a view of the helical angle represented.

FIGS. 21A and 21B is a view of the helical angle 211 of the worm gear 60. For example, worm gear 60 is shown with a longitudinal line 210, a latitudinal line 212 a helical angle line 214 which corresponds to the helical angle of the threads of the worm gear. There are also lines 216 and 218 which correspond to the flare angle 213 of worm gear. This helical angle a is a pre-set angle which corresponds to the angle of the path of the groove 202 shown in FIG. 19 so that when the worm gear rotates and is driven up by spring 50, it meshes with contoured region 67 of sliding block 66 so that it effects a proper meshing of the two components.

Figure 21C:
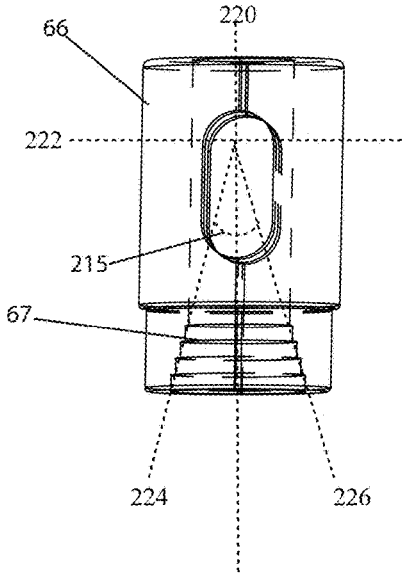
FIG. 21C is a side view of the sliding block.
Figure 21C:
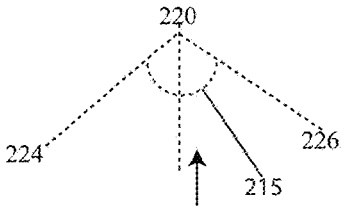
Figure 21D:
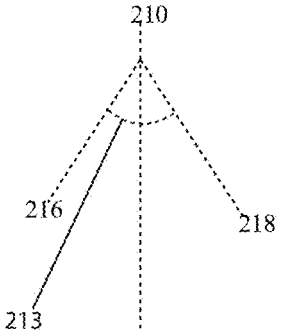
FIG. 21D is a side view of the angles of expansion of both the contoured region of the sliding block and the angle of expansion of the worm gear.

FIG. 21C is a view of the sliding block 66 having contoured region 67. Contoured region 67 has a flare angle 215 formed by lines 224 and 226 which are extensions of the angle of expansion of the contoured region 67. As shown in FIG. 21D the flare angle 215 is a little wider than flare angle 213. This allows for the complete absorption of the worm gear into the contoured region 67 of sliding block 66 and allows for a gradual but complete meshing of these two components.

FIG. 22A is a side view of another embodiment of a gear 230 which can be inserted instead of worm gear 60. This gear 230 has a gear body 232, and a toothed section 234. There is a narrower section 236 which is configured to be coupled to an end 50.2 of a spring such as spring 50. There is also a further tapered section 238. There is also shown a block 245 which can move as a sliding block such as sliding block 66. This block 245 has a plurality of teeth 242 and 244. FIG. 22B shows another view of the gear 230 which includes gear body 232, teeth 234, a central column or hole 237 for receiving the drive pin 92, and a side hole 240 which allows this gear to be coupled to pin 46. FIG. 22C is a side view of the device which shows channel or hole 237 and opposite channel or hole 239 which is extending in narrower section 236.

FIG. 22D shows an end view of channel or hole 239 in body 232. FIG. 22E shows a side view of gear 230 with body 232, teeth 234, narrower section 236, and tapered section 238.

Accordingly, while at least one embodiment of the present invention have been shown and described, it is to be understood that many changes and modifications may be made thereunto without departing from the spirit and scope of the invention as defined in the appended claims.

What is claimed is:

1. A selectively closable hinge comprising:

a hinge comprising a door leaf and a frame leaf, wherein each of said door leaf and said frame leaf comprises a knuckle;

a fuse which is configured to react in response to an elevated temperature;

a biasing element configured to bias the hinge into a closed position;

a locking pin configured to selectively engage a knuckle of said door leaf or said frame leaf; and a guide configured to guide a movement of said locking pin and said hinge when the hinge moves from an open position to the closed position; and wherein the biasing element is a torsion spring, said guide is a channel, and wherein the hinge further comprises a gear, wherein said torsion spring is biased in a first position by pressure from said fuse, and said gear is positioned in a disengaged position, wherein when a temperature reaches a predetermined level, said fuse becomes compromised, said torsion spring, is released from said first position, and wherein said gear moves from a disengaged position to an engaged position thereby allowing said gear in combination with said torsion spring to drive the hinge to a closed position.

2. The hinge as in claim 1, wherein the open position of the hinge is when the door leaf is pushed away from said frame leaf in a rotational manner.

3. The hinge as in claim 1, wherein said fuse is a fusable pin and is substantially cylindrical.

4. The hinge as in claim 1, wherein said door leaf knuckle and said frame leaf knuckle are disposed adjacent to each other.

5. The hinge as in claim 1, wherein said guide comprises a slot for guiding said locking pin which is configured to move when said fuse is broken, and wherein said locking pin is configured to move from a locked position to an unlocked position when said fuse is broken.

6. The hinge as in claim 5, wherein when said locking pin moves from a locked position to an unlocked position, the hinge is configured to move from an open position to a closed position.

7. The hinge as in claim 1, further comprising a sliding block which is substantially rotationally fixed but axially movable when said gear engages with said sliding block.

8. The hinge as in claim 7, wherein said sliding block is axially movable from a first position to a second position wherein said gear locks with said sliding block as said sliding block approaches said second position.

* * * * *